US007827959B2

(12) United States Patent
Yamauchi

(10) Patent No.: US 7,827,959 B2
(45) Date of Patent: Nov. 9, 2010

(54) IGNITION DEVICE FOR INTERNAL COMBUSTION ENGINE

(75) Inventor: Yuki Yamauchi, Kariya (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 238 days.

(21) Appl. No.: 12/170,084

(22) Filed: Jul. 9, 2008

(65) Prior Publication Data

US 2009/0018758 A1 Jan. 15, 2009

(30) Foreign Application Priority Data

Jul. 11, 2007 (JP) ..... 2007-181686
Apr. 2, 2008 (JP) ..... 2008-095789

(51) Int. Cl.
*F02P 11/00* (2006.01)

(52) U.S. Cl. ..... 123/406.13; 123/406.6; 123/406.66; 123/618

(58) Field of Classification Search ..... 123/406.13, 123/406.18, 406.6, 406.66, 618, 619, 626, 123/630, 637
See application file for complete search history.

(56) References Cited

U.S. PATENT DOCUMENTS 3,906,258 A * 9/1975 Moe ..... 327/36
4,112,895 A * 9/1978 Habert ..... 123/406.66
4,201,173 A * 5/1980 Okada et al. ..... 123/638
4,493,307 A * 1/1985 Trinh et al. ..... 123/630
4,520,781 A * 6/1985 Nishida ..... 123/406.61
4,615,318 A * 10/1986 Imoto et al. ..... 123/612
5,056,496 A 10/1991 Morino et al.
5,056,497 A 10/1991 Akagi et al.
5,896,848 A * 4/1999 Dixon ..... 123/609
2002/0017284 A1* 2/2002 Masters ..... 123/597

* cited by examiner

*Primary Examiner*—Erick Solis
(74) *Attorney, Agent, or Firm*—Nixon & Vanderhye PC

(57) ABSTRACT

An ignition device (ECU and a drive circuit) for a spark ignition type internal combustion engine that directs an ignition with generation of a predetermined start signal (i.e., falling of an ignition signal) has a circuit for monitoring generation timing of the start signal and for prohibiting the ignition based on the start signal when the start signal is generated at abnormal timing. In particular, the ignition device has a circuit for determining whether the start signal is generated at predetermined start timing and a circuit for prohibiting the ignition based on the start signal when the above circuit determines that the start signal is not generated at the start timing. Thus, damages to the engine and peripheral devices due to the ignition at the abnormal timing can be reduced.

15 Claims, 18 Drawing Sheets

IGNITION DEVICE FOR INTERNAL COMBUSTION ENGINE

CROSS REFERENCE TO RELATED APPLICATION

This application is based on and incorporates herein by reference Japanese Patent Applications No. 2007-181686 filed on Jul. 11, 2007 and No. 2008-095789 filed on Apr. 2, 2008.

BACKGROUND OF THE INVENTION

1. Field of the Invention

The present invention relates to an ignition device for an internal combustion engine, and in particular, to an ignition device used as a multiple electric discharge ignition type ignition device that causes an ignition plug to perform multiple times of ignition electric discharge in one combustion cycle.

2. Description of Related Art

In a spark ignition type internal combustion engine, ignition electric discharge is caused in an ignition plug in a combustion chamber by driving an ignition device consisting of an ignition coil and the like. Fuel introduced into the combustion chamber is combusted by the ignition electric discharge. In recent years, in order to improve a combustion state in the combustion chamber or to reduce power consumption, a multiple electric discharge ignition type ignition device has been proposed (for example, as described in Japanese Patent Gazette No. 2811781). The multiple electric discharge ignition type ignition device causes the ignition plug to perform multiple times of ignition electric discharge during one combustion cycle.

An example of the multiple electric discharge ignition type ignition device is shown in FIG. 14 as a circuit diagram. For example, the ignition device is used as an ignition device of an in-vehicle internal combustion engine. Next, an explanation will be given by assuming that the internal combustion engine is a four-cylinder engine that performs the ignition sequentially in the cylinders #1, #3, #4, and #2 in this order.

As shown in FIG. 14, the ignition device is mainly composed of an ECU (electronic control unit) and a drive circuit (i.e., an igniter). The ECU is mainly constituted by a well-known microcomputer. The ECU acquires engine operation states such as engine rotation speed and an accelerator operation amount (i.e., a pressing amount of an accelerator by a driver) and inputs the operation states to a signal output section 101. The signal output section 101 calculates optimum ignition timing (equivalent to ignition timing in normal control) based on the engine operation states and generates ignition signals IGt1, IGt2, IGt3, IGt4 (signals corresponding to the respective cylinders #1, #3, #4, #2) corresponding to the optimum ignition timing. The signal output section 101 calculates a multiple electric discharge period (i.e., a period for continuously performing multiple electric discharge ignition) based on the engine operation states and generates a multiple period signal IGw corresponding to the multiple electric discharge period. The drive circuit has a control section 201 as a circuit for performing predetermined control related to the ignition in the internal combustion engine. The control section 201 has an energy accumulation control section 201*a* and a multiple ignition control section 201*b*. The control section 201 controls energization/de-energization of an ignition coil L1 by the respective control sections based on the ignition signals IGt1, IGt2, IGt3, IGt4 and the multiple period signal IGw from the signal output section 101.

In more detail, in the drive circuit, an in-vehicle battery B1 (a direct-current power supply), a coil L10 for accumulating an energy, and a transistor Tr11 as a switching element are connected in series with each other. A series circuit of a diode D1 for preventing a backflow of current by rectification, a primary ignition coil L1*a*, and a normally-off type transistor Tr21 (an end thereof is grounded), which is switched on when a logically high (H) electric potential is applied to a gate thereof, is electrically connected in series with the coil L10 (and in parallel with the transistor Tr11). A capacitor C1 (an end thereof is grounded) is electrically connected in series with the diode D1 (and in parallel with the primary ignition coil L1*a*).

The primary ignition coil L1*a* is paired with a secondary ignition coil L1*b* to constitute the ignition coil L1. The ignition coil L1 is provided for each cylinder of the engine (the internal combustion engine) In the case of the four-cylinder engine, four ignition coils L1 are provided. In the ignition device, with such the ignition coil L1, high voltage is induced in the secondary ignition coil L1*b* by using the electromagnetic induction by the primary ignition coil L1*a*. Thus, the high voltage and eventual ignition electric discharge are caused in an ignition plug (i.e., an ignition plug provided to the combustion chamber of the engine) connected to the coil L1*b*.

FIG. 15 shows details of the structure of the multiple ignition control section 201*b*. As shown in FIG. 15, in the multiple ignition control section 201*b*, an AND circuit 211 and a cylinder determination circuit 221 are provided for the cylinder #1. A drive signal Dr2 and a cylinder determination signal G11 are inputted into the AND circuit 211. An output of the AND circuit 211 is inputted into the gate of the transistor Tr21 as a switching signal G21. The drive signal Dr2 is an output of an AND circuit 210, into which the multiple period signal IGw and a drive signal Dr1 are inputted. The drive signal Dr1 is a pulse signal that repeatedly alternates between ON and OFF in a predetermined cycle during a period from falling of one of the ignition signals IGt1, IGt2, IGt3, IGt4 to falling of the multiple period signal IGw. The cylinder determination signal G11 indicates the cylinder as an ignition target and is generated by the cylinder determination circuit 221 based on the ignition signal IGt1. In more detail, the cylinder determination signal G11 becomes logically high (H) since the ignition signal IGt1 falls until a specified time elapses after the falling of the ignition signal IGt1.

An AND circuit 212 and a cylinder determination circuit 222 similar to the AND circuit 211 and the cylinder determination circuit 221 are provided also for the cylinder #3. The drive signal Dr2 and a cylinder determination signal G12 are inputted into the AND circuit 212. An output of the AND circuit 212 is inputted into a gate of a transistor Tr22 as a switching signal G22. Although not shown in the drawing, the ignition device has similar AND circuits and cylinder determination circuits also for the cylinders #2, #4.

The drive circuit shown in FIG. 14 having the multiple ignition control section 201*b* energizes the primary ignition coil L1*a* by discharging the electric charge accumulated in the capacitor C1 to cause the ignition plug to perform the first ignition electric discharge at the timing based on the ignition signal IGt1 and the multiple period signal IGw from the signal output section 101. Then, the drive circuit alternately switches on and off the transistor Tr11 and the transistor Tr21 in a fixed cycle. Thus, the current flows through the coil L10 and eventually an inductive energy (electric energy) is accumulated in the coil L10 when the transistor Tr21 is switched off and the transistor Tr11 is switched on. The inductive energy accumulated in the coil L10 is discharged and eventually the current flows through the primary ignition coil L1*a* when the transistor Tr11 is switched off and the transistor Tr21 is switched on. The ignition device thus causes the electricity to flow through the secondary ignition coil L1*b* in a forward direction and a backward direction during the multiple electric discharge period such that the ignition coil L1 repeatedly performs the ignition electric discharge. Thus, the ignition device performs the multiple electric discharge with the ignition plug electrically connected to the ignition coil L1 (in more detail, to the secondary ignition coil L1*b*).

FIG. 16 is a timing chart showing an operation mode of the above-described ignition device. Next, an operation mode of the above-described ignition device will be explained by specifically paying an attention to an ignition in a cylinder (cylinder #1) among the multiple cylinders. Fundamentally, the ignition control is performed by the similar operation also for the other cylinders. In FIG. 16, part (a) shows a transition of the ignition signal IGt1, part (b) shows a transition of the multiple period signal IGw, part (c) shows the switching signal G21 for the transistor Tr21, and parts (d) to (g) respectively show currents i11 i12, i1, i2 respectively flowing through the coil L10, the transistor Tr11, the primary ignition coil L1*a* and the secondary ignition coil L1*b*.

As shown in part (a) of FIG. 16, in this example, the ignition signal IGt1 is switched on (i.e., becomes logically high (H)) at timing t101. Thus, the transistor Tr11 is switched on, and the currents i11, i12 increase gradually as shown in parts (d) and (e) of FIG. 16.

Then, the ignition signal IGt1 is returned from the ON state to the OFF state (logically low (L) state) at timing t102. As shown in part (b) of FIG. 16, the multiple period signal IGw is switched on in synchronization with the falling of the ignition signal IGt1. In a period from t102 to t109 in which the multiple period signal IGw is ON (i.e., a period from the falling of the ignition signal IGt1 to the falling of the multiple period signal IGw), the switching signal G21 for the transistor Tr21 turns into a pulse signal that repeatedly alternates between ON and OFF in a predetermined cycle as shown in part (c) of FIG. 16. Thus, the transistor Tr21 is switched on and off, and correspondingly, the currents i11, i12 start to repeat increasing and decreasing as shown in parts (d) and (e) of FIG. 16.

In more detail, the transistor Tr11 is switched off at the timing t102. Thus, the electric energy accumulated in the coil L10 and the capacitor C1 is discharged to the primary ignition coil L1*a* and eventually to the secondary ignition coil L1*b*, so the electric discharge is performed by the ignition plug electrically connected to the coil L1*b*. In order to effectively exploit the energy accumulated in the capacitor C1, it is preferable to set the first pulse width (a period from t102 to t103) to be wider than the other following pulse widths (periods t103-t104, t104-t105, etc.).

Furthermore, at timing t103 when a predetermined time elapses after the timing t102, the transistor Tr21 is switched off and the transistor Tr11 is switched on, so the energy is accumulated in the coil L10. Then, the transistor Tr11 is switched off and the transistor Tr21 is switched on at following timing t104. Thus, the electric energy accumulated in the coil L10 is discharged to the primary ignition coil L1*a* and eventually to the secondary ignition coil L1*b*, so the electric discharge is performed by the ignition plug as described above. Also after that, the accumulation of the energy and the discharge of the energy are performed alternately at respective timings t105-t109. Thus, multiple electric discharge ignition is realized. The multiple period signal IGw is switched off and the ON/OFF drive of the switching signal G21 stops at the following timing t109.

Next, another example of the multiple electric discharge ignition type ignition device will be explained with reference to FIG. 17. FIG. 17 is a circuit diagram corresponding to FIG. 14. The same sign is used for the same element shown in both of FIGS. 14 and 17 and the explanation of the element is not repeated here. The ignition device shown in FIG. 17 is also used as an ignition device for an in-vehicle internal combustion engine.

The ignition device shown in FIG. 17 is also mainly composed of an ECU (electronic control unit) and a drive circuit (i.e., an igniter) like the device shown in FIG. 14. The ignition device shown in FIG. 17 has a signal output section 102, a control section 202, an energy accumulation control section 202*a*, and a multiple ignition control section 202*b* as sections similar to the signal output section 101, the control section 201, the energy accumulation control section 201*a*, and the multiple ignition control section 201*b* of the device shown in FIG. 14. Among the sections, the multiple ignition control section 202*b* has a structure similar to that of the multiple ignition control section 201*b* shown in FIG. 15. However, in place of the transistor Tr11 and the coil L10 of the device shown in FIG. 14, the device shown in FIG. 17 has a Vdc booster mechanism 302*a* and a Vcdi booster mechanism 302*b* to realize more precise ignition control.

The Vdc booster mechanism 302*a* has a capacitor of a large capacity and charges the capacitor at prescribed voltage. If the transistor Tr21 in the ignition device is switched on, high voltage is generated in the secondary ignition coil L1*b* and therefore excitation voltage is generated in the primary ignition coil L1*a*. The current i1 flowing through the primary ignition coil L1*a* can be maintained for a certain time by charging the capacitor of the Vdc booster mechanism 302*a* at voltage (for example, 50V) higher than the excitation voltage. The Vdc booster mechanism 302*a* is connected to the capacitor C1 through the diode D1. Thus, the backflow of the current from the capacitor C1 to the Vdc booster mechanism 302*a* is prevented.

The Vcdi booster mechanism 302*b* has a function to charge the capacitor C1. With this structure, re-ignition can be performed by charging the capacitor C1 with the Vcdi booster mechanism 302*b* until contact voltage between the capacitor C1 and the primary ignition coil L1*a* reaches a voltage (for example, 250V) higher than a voltage calculated by multiplying a turn ratio of the ignition coil L1 and re-ignition request voltage, and by discharging the capacitor C1 after the charging. The turn ratio of the ignition coil L1 is calculated by dividing the number of turns of the primary ignition coil L1*a* by the number of turns of the secondary ignition coil L1*b*.

FIG. 18 is a timing chart showing an operation mode of the ignition device described above, In FIG. 18, part (a) shows a transition of the ignition signal IGt1, pad (b) shows a transition of the multiple period signal IGw, part (c) shows a transition of the switching signal G21 for the transistor Tr21 part (d) shows a transition of a quantity VC1 of the electric charge accumulated in the capacitor C1, part (e) shows a transition of the current i1 flowing through the primary ignition coil L1*a*, and part (f) shows a transition of the current i2 flowing through the secondary ignition coil Lib respectively.

As shown in part (a) of FIG. 18, in this example, the ignition signal IGt1 is switched on (i.e., becomes logically high (H)) at timing t201 and is switched off (i.e., becomes logically low (L)) at timing t202. In a period from t202 to t209 corresponding to the period from t102 to t109 shown in FIG. 16, the switching signal G21 turns into a pulse signal that repeatedly alternates between ON and OFF in a predetermined cycle. The ignition device of this example switches the transistor Tr21 between ON and OFF based on the current i2 and the electric charge quantity VC1 accumulated in the capacitor C1 as shown in parts (c), (d) and (f) of FIG. 18. In more detail, the transistor Tr21 is switched off when the current i2 reaches a predetermined threshold (for example, 50 mA), and the transistor Tr21 is switched on when the electric charge quantity VC1 reaches another predetermined threshold (for example, 250V). The threshold (for example, 50 mA) of the current i2 is set at a value that does not cause a misfire of the combustion in the combustion chamber.

Thus, each of the above-described ignition devices performs the ignition control of each cylinder based on the falling of each of the ignition signals IGt1, IGt2, IGt3, IGt4. However, as for the various signals related to the ignition control, there is a possibility that the ignition signal IGt1 is outputted for an abnormally long time, for example, as shown in FIG. 19, due to an engine stall, disturbances (noises) and the like. In such the case, there is a concern that the above-described ignition device erroneously recognizes (misidentifies) the timing t202, at which the ignition signal IGt1 falls, as the ignition timing and performs the ignition at the timing different from desired timing t202*a*. in such the case, there is a concern that a backfire is caused with an opening operation of an engine intake valve because of delay in the ignition timing, causing a large damage to the engine or peripheral devices such as injectors and sensors.

SUMMARY OF THE INVENTION

It is an object of the present invention to provide an ignition device of an internal combustion engine capable of reducing a damage to an engine, peripheral devices and the like resulting from ignition at abnormal timing.

According to an aspect of the present invention, an ignition device for a spark ignition type internal combustion engine that directs ignition with generation of a predetermined start signal has a timing determination device for determining whether the start signal is generated at predetermined start timing and a prohibition device for prohibiting the ignition based on the start signal when the timing determination device determines that the start signal is not generated at the start timing.

According to another aspect of the present invention, an ignition device for a spark ignition type internal combustion engine that directs ignition with generation of a predetermined start signal has a monitoring device for monitoring generation timing of the start signal and a prohibition device for prohibiting the ignition based on the start signal when the start signal is generated at abnormal timing.

With such the structures, when the start signal is generated at abnormal timing, the ignition at the abnormal timing based on the start signal can be prohibited, thereby reducing a damage to the engine, the peripheral devices, and the like resulting from the abnormal ignition.

According to another aspect of the present invention, in the ignition device, the start timing is set as timing when a predetermined time elapses after generation of a predetermined reference signal and the timing determination device determines whether the start signal is generated at the start timing based on time from the generation of the reference signal to the generation of the start signal. With such the construction, it is easily and appropriately determined whether the above-described start signal is generated at the start timing based on the time from the generation of the above-described reference signal to the generation of the start signal.

According to another aspect of the present invention, the timing determination device starts charging of a time measuring capacitor when the reference signal is generated and determines whether the start signal is generated at the start timing based on whether a charged amount of the time measuring capacitor exceeds a permissible level before the start signal is generated. Thus, it can be determined easily and appropriately whether the start signal is generated at the start timing based on the charged amount of the capacitor.

According to another aspect of the present invention, the timing determination device determines whether the start signal is generated at the start timing based on magnitude of an output voltage of a comparator into which a voltage corresponding to the charged amount of the time measuring capacitor and a specified electric potential corresponding to the permissible level are inputted. Thus, the above-described construction can be realized easily and appropriately with a well-known circuit.

According to another aspect of the present invention, in the ignition device, the timing determination device determines whether the start signal is generated at the start timing based on a count value of a counter circuit that counts the time number of generation of a periodic signal generated in a fixed cycle.

In this case, in the counter circuit, the count value of the counter circuit is counted up or down in accordance with the generating time number of the periodic signal. Therefore, an exact elapsed time from the generating timing of the reference signal to the generating timing of the start signal can be grasped. Thus, it can be determined correctly whether the start signal is generated at the start timing.

According to another aspect of the present invention, when the count value of the counter circuit is set to a reference value at the generation timing of the reference signal, the timing determination device can determine whether the start signal is generated at the start timing based on comparison between the count value of the counter circuit and a permissible value.

According to another aspect of the present invention, in the ignition device, the timing determination device outputs a result of the determination of whether the start signal is generated at the predetermined start timing as an output of an RS flip-flop, into which a reset signal is inputted when the reference signal is generated and a set signal is inputted when the time from the generation of the reference signal to the generation of the start signal becomes longer than a permissible level. Thus, the timing determination device can be realized with a well-known circuit easily and appropriately.

According to another aspect of the present invention, in the ignition device, the ignition directed by the generation of the start signal is performed as multiple electric discharge ignition for performing the ignition multiple times during one combustion cycle. The ignition device has a multiple period signal outputting device for outputting a multiple period signal indicating a period for continuously performing the multiple electric discharge ignition when the start signal is generated, a pulse signal outputting device for outputting a pulse signal directing the multiple electric discharge ignition during the output of the multiple period signal, and a multiple electric discharge ignition performing device for performing the multiple electric discharge ignition during the output of the pulse signal based on the pulse signal. The prohibition device prohibits the output of the pulse signal when the timing determination device determines that the start signal is not generated at the start timing. Thus, the ignition at the abnormal timing can be appropriately prohibited while realizing the multiple electric discharge ignition.

According to another aspect of the present invention, the internal combustion engine performs the ignition by energizing an ignition plug and energization/de-energization of the ignition plug switches in accordance with an ON/OFF state of an ignition switch as a switching element such as a transistor. The ignition device has a switch control circuit for switching the ON/OFF state of the ignition switch based on one or more predetermined parameters.

According to another aspect of the present invention, the ignition device has a signal determination device for determining whether both of a switch signal indicating an ON/OFF mode of the ignition switch and the start signal are generated. The ignition switch is a normally-off type switching element. The switch control circuit switches the ON/OFF state of the ignition switch in an ON/OFF mode corresponding to the switch signal when the signal determination device determines that both of the switch signal and the start signal are generated. When the prohibition device performs the prohibition, the prohibition device invalidates at least one of the switch signal and the start signal to cause the signal determination device to determine that at least one of the switch signal and the start signal is not generated.

With such the structures, in a period when the prohibition device performs the prohibition, the switch control circuit cannot control the ignition switch and the ignition switch is held at the off state. Thus, the energization of the ignition plug and eventually the execution of the ignition by the ignition plug are prohibited. Accordingly, the prohibition device can be realized easily and appropriately with the above-described structure.

According to another aspect of the present invention, the ignition device includes an ignition coil having a primary coil and a secondary coil for controlling the energization/de-energization of the ignition plug. Energization/de-energization of the primary coil switches in accordance with the ON/OFF state of the ignition switch and the secondary coil is provided to an energization route of the ignition plug. With such the structure, the energization/de-energization of the ignition plug can be controlled appropriately.

According to another aspect of the present invention, the ignition device includes a multiple electric discharge performing device for repeatedly switching on and off the ignition switch to cause a primary current to intermittently flow through the primary coil such that a secondary current is repeatedly generated in the secondary coil when the start signal is generated, thereby causing the ignition plug to perform the multiple electric discharge. With such the construction, the multiple electric discharge ignition can be realized appropriately.

According to another aspect of the present invention, the ignition device includes an ignition capacitor that is used for the ignition and is connected in parallel with the primary coil. The ignition switch is connected in series with the primary coil. The primary coil is supplied with an electric charge accumulated in the ignition capacitor when the ignition switch is switched on. With such the structure, sufficiently high voltage can be easily and appropriately applied to the primary ignition coil.

According to another aspect of the present invention, in the ignition device, the prohibition device allows the ignition switch to be switched on by the generation of the start signal when the prohibition device does not perform the prohibition and prohibits the ignition switch from being switched on even if the start signal is generated when the prohibition device performs the prohibition.

With such the construction, when the prohibition by the prohibition device is not performed, the ignition switch is switched on by the generation of the start signal. When the prohibition by the prohibition device is performed, the ignition switch is not switched on even if the start signal is generated. With such the construction, the ignition at the abnormal timing can be prohibited appropriately.

In the case where the control is performed by using the microcomputer and the like as in the case of the ECU (shown in FIG. 14 or 17) mentioned above, the prohibition of the ignition by the prohibition device may be performed with software (i.e., a program), for example. However, it is more useful to perform the prohibition with hardware (specifically with a circuit) in order to surely perform the prohibition.

More specifically, according to another aspect of the present invention, in the ignition device, the prohibition device prohibits the switching on of the ignition switch with a circuit when the prohibition device performs the prohibition.

In this case, according to another aspect of the present invention, in the ignition device, the ignition switch is a normally-off type transistor that is switched on if a logically high electric potential is applied to a gate thereof, and the prohibition device fixes the electric potential of the gate to a logically low potential when the prohibition device performs the prohibition. With such the construction, the above-described prohibition can be realized easily and appropriately.

According to another aspect of the present invention, the internal combustion engine is a multi-cylinder engine having multiple cylinders, and the ignition device has a cylinder determination and ignition performing device for determining which one of the cylinders is a target cylinder that should perform the ignition presently and for performing the ignition in the target cylinder based on the start signal when the prohibition by the prohibition device is not performed. The timing determination device determines whether the start signal is generated at the predetermined start timing in the target cylinder. When the timing determination device determines that the start signal is not generated at the start timing, the prohibition device prohibits the ignition based on the start signal only in the target cylinder related to the determination.

With such the construction, the above-described prohibition can be suitably realized for each cylinder of the multi-cylinder engine. Moreover, the prohibition is performed selectively only in the target cylinder. Thus, the prohibition can be performed individually for each cylinder.

According to another aspect of the present invention, the ignition device has a storage device for storing information indicating which cylinder is prohibited from performing the ignition by the prohibition device among the cylinders. Thus, data analysis through data accumulation, failure diagnosis of an engine ignition system and the like can be performed easily and appropriately.

According to yet another aspect of the present invention, the ignition device has a cylinder determination and ignition performing device for determining which one of the cylinders is a target cylinder that should perform the ignition presently and for performing the ignition in the target cylinder based on the start signal when the prohibition by the prohibition device is not performed. The timing determination device determines whether the start signal is generated at the predetermined start timing in the target cylinder. When the timing determination device determines that the start signal is not generated at the start timing, the prohibition device prohibits the ignition based on the start signal in all of the cylinders including the target cylinder related to the determination.

With such the construction, the above-described prohibition can be suitably realized for the respective cylinders of the multi-cylinder engine.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Hereafter, an ignition device of an internal combustion engine according to a first embodiment of the present invention will be described with reference to FIGS. 1 to 6. A general structure of the ignition device according to the present embodiment is similar to that of the device shown in FIG. 14. A general structure of a multiple ignition control section 201*b* of the ignition device according to the present embodiment is similar to the structure shown in FIG. 15. Therefore, in the following description, explanation about common structure and operation is omitted, and differences between the device according to the present embodiment and the device shown in FIG. 15 will be mainly explained.

Figure 1:
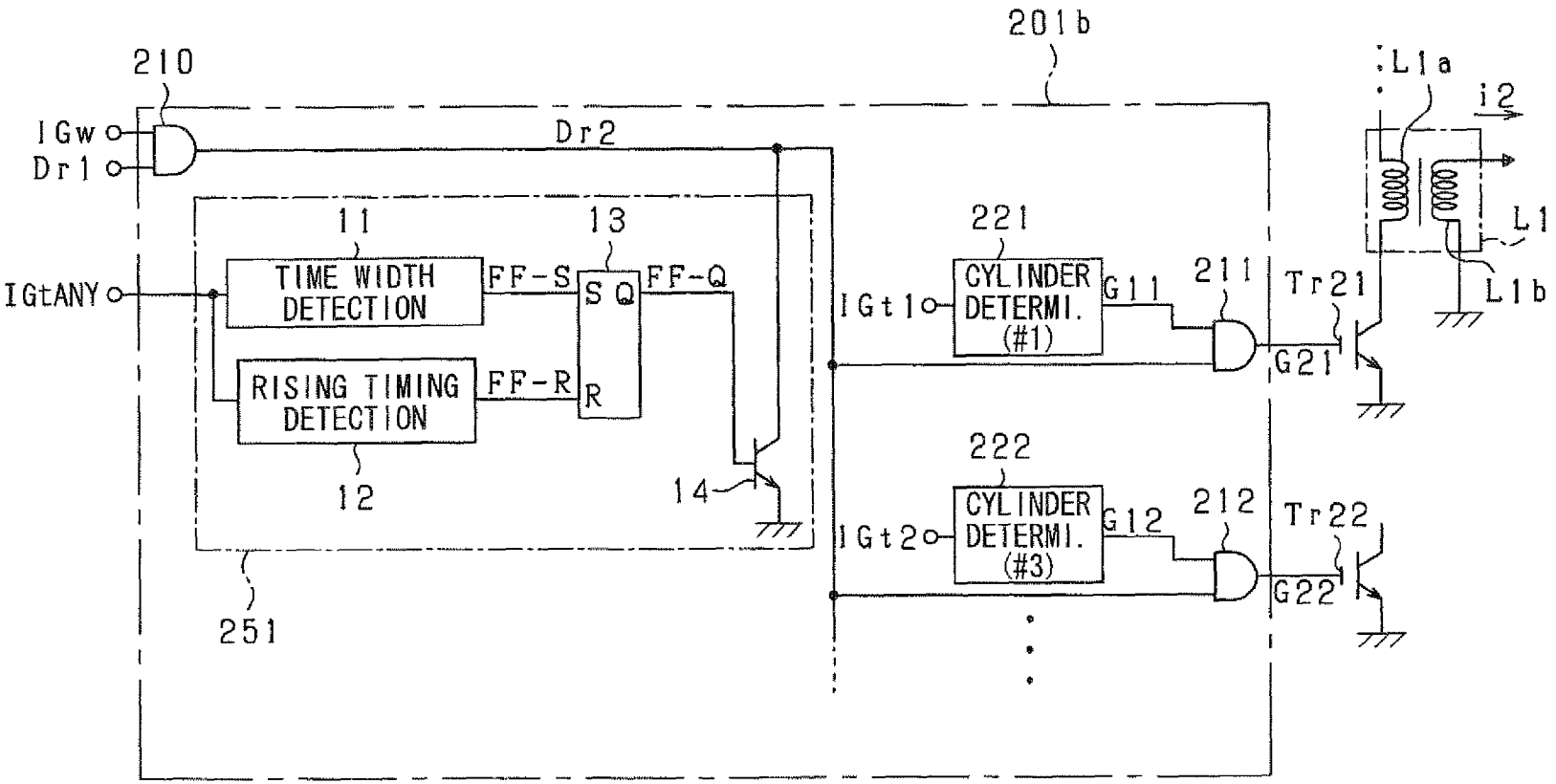
FIG. 1 is a circuit diagram showing an ignition device for an internal combustion engine according to a first embodiment of the present invention.

First, a general structure of the ignition device according to the present embodiment will be explained with reference to FIG. 1. FIG. 1 is a circuit diagram corresponding to FIG. 15. The same sign is used for the same element shown in both of FIGS. 1 and 15 and the explanation of the element is not repeated here.

A multi-cylinder engine (for example, an in-line four-cylinder engine) mounted in a four-wheel vehicle is assumed as an engine (not shown) as a control target of the device according to the present embodiment. In the engine, injectors are provided in intake passages (in more detail, in inlet ports) of the respective cylinders. Fuel supplied by each injector is burned in each cylinder. The engine is a four-stroke (four-piston-stroke) reciprocating gasoline engine (a spark ignition type internal combustion engine) that rotates an output shaft (a crankshaft) by converting an energy generated by combustion of the fuel into rotary motion. In the engine, a target cylinder at the time is sequentially determined by a cylinder determination sensor (an electromagnetic pickup) provided to a camshaft of the a suction valve or an exhaust valve. In each of the four cylinders #1-#4, a combustion cycle consisting of four strokes of an intake stroke, a compression stroke, a combustion stroke (or an ignition stroke), and an exhaustion stroke is sequentially performed in a cycle of 720° CA. in the order of the cylinders #1, #3, #4 and #2, and in more detail, while the combustion cycles are deviated from each other by 180°CA. between the cylinders.

Figure 15:
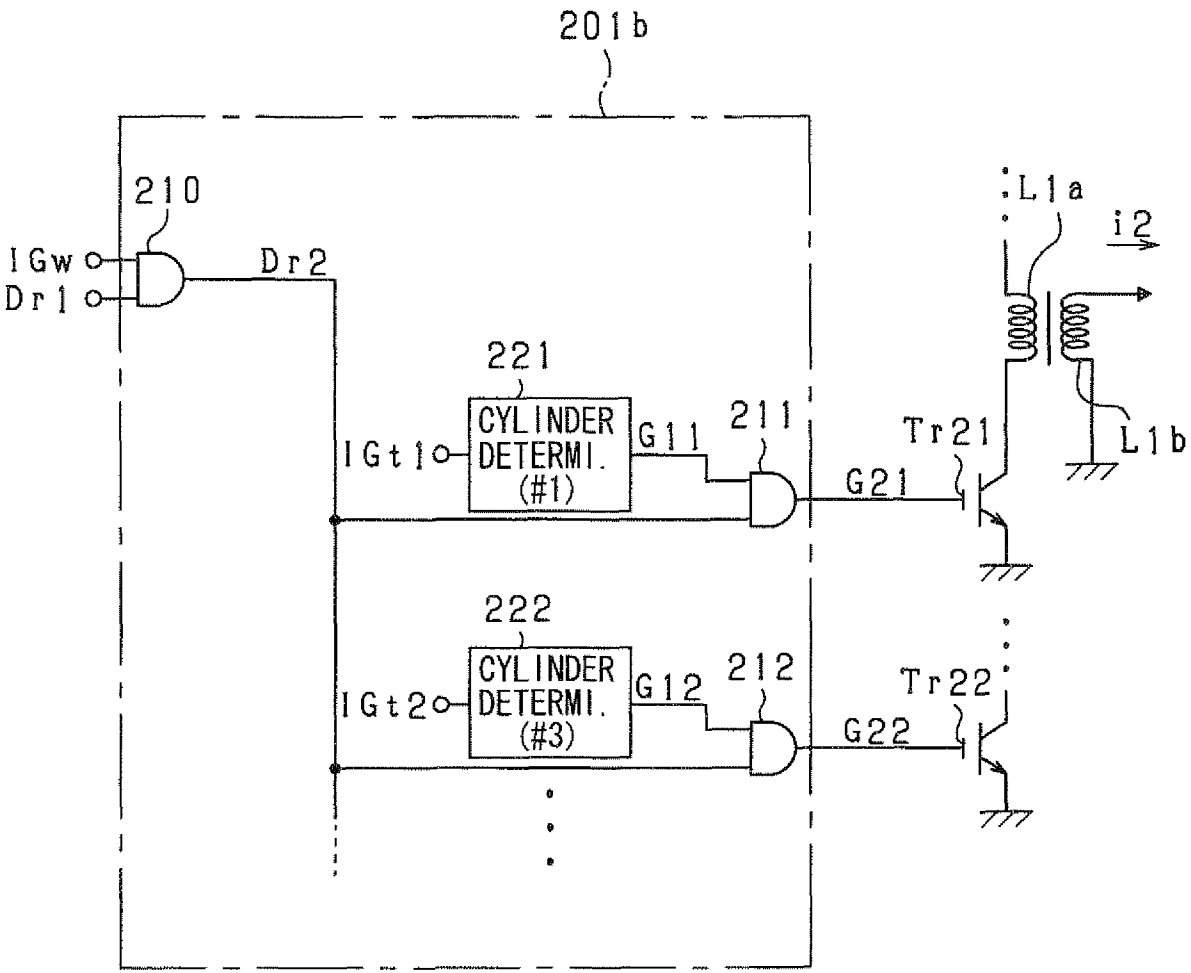
FIG. 15 RELATED ART
FIG. 15 is a circuit diagram showing the ignition device of the related art.
Figure 16:
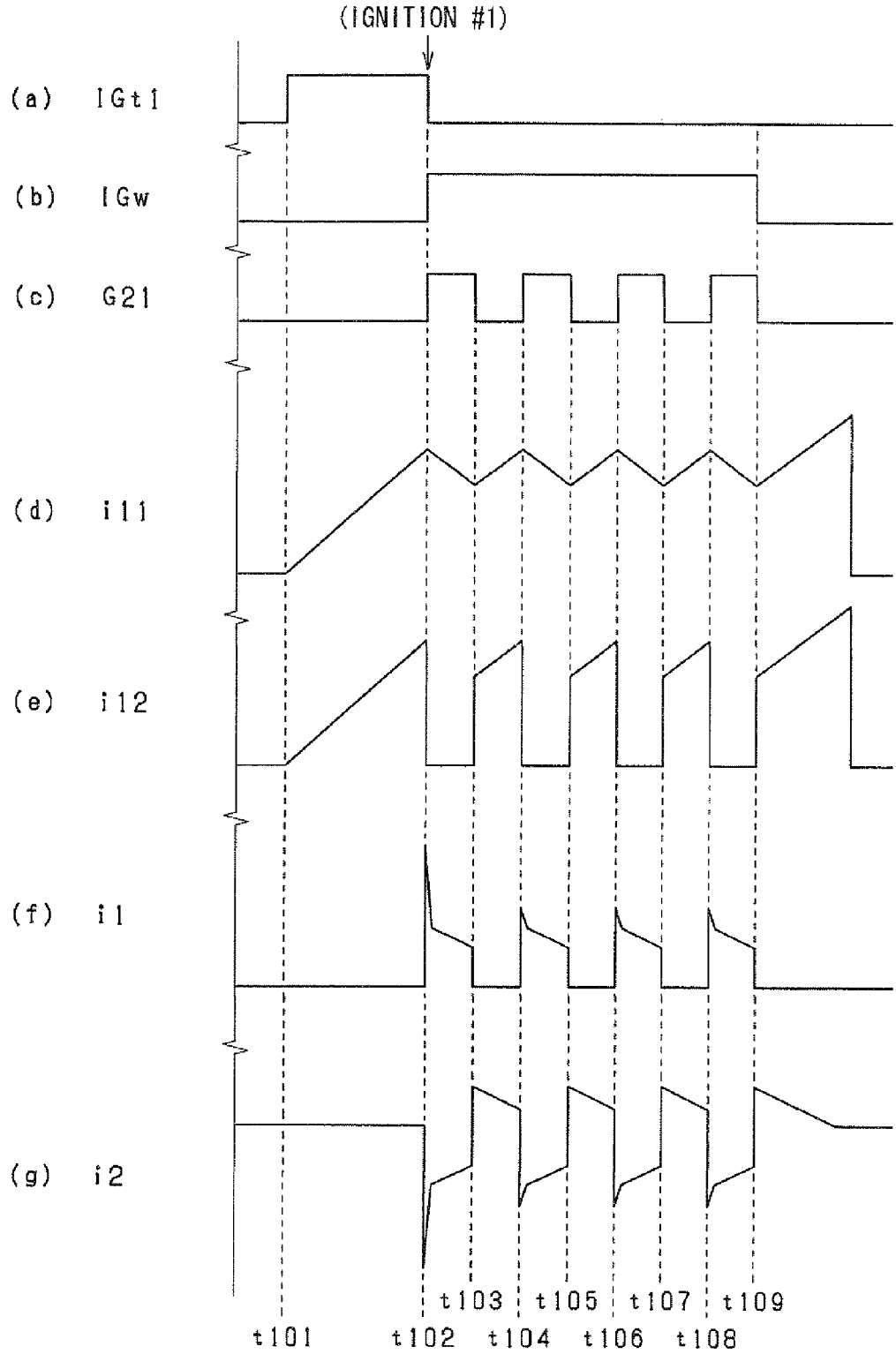
FIG. 16 RELATED ART
FIG. 16 is a timing chart showing an operation mode of the ignition device of the related art.

Like the structure shown in FIG. 15, as shown in FIG. 1, the multiple ignition control section 201*b* also has an AND circuit 211 and a cylinder determination circuit 221 for the cylinder #1. In the device, a drive signal Dr2 and a cylinder determination signal G11 are inputted to the AND circuit 211, and an output of the AND circuit 211 is inputted into a gate of a transistor Tr21 as a switching signal G21. Moreover, the device has an AND circuit 212 and a cylinder determination circuit 222 for the cylinder #3 as elements similar to the AND circuit 211 and the cylinder determination circuit 221. In the device, the drive signal Dr2 and a cylinder determination signal G12 are inputted into the AND circuit 212, and an output of the AND circuit 212 is inputted into a gate of a transistor Tr22 as a switching signal G22. Although not shown, the ignition device also has similar AND circuits and cylinder determination circuits for the cylinders #2, #4 like the structure shown in FIG. 15. However, in the present embodiment, a wrong ignition prevention circuit 251 is additionally provided to the structure. The circuit 251 prohibits the input of the drive signal Dr2 to the AND circuits (the AND circuits 211, 212, etc.) of the cylinders (i.e., the drive signal Dr2 is invariably set to the logically low state (L)) during a predetermined period.

In more detail, the drive signal Dr2 is an output of an AND circuit 210, into which a multiple period signal IGw and a drive signal Dr1 are inputted. The drive signal Dr1 is a pulse signal that repeatedly alternates between ON and OFF in a predetermined cycle after falling of each of ignition signals IGt1, IGt2, IGt3, IGt4 to falling of the multiple period signal IGw. The cylinder determination signal G11 is generated by the cylinder determination circuit 221 based on the ignition signal IGt1. In more detail, the cylinder determination signal G11 becomes logically high (H) since the falling of the ignition signal IGt1 occurs until a specified time elapses after the falling.

The wrong ignition prevention circuit 251 has a time width detection circuit 11, a rising timing detection circuit 12, an RS flip-flop 13, and a transistor 14. The circuit 251 is structured such that an ignition signal IGtANY (a signal that is turned on when any one of the ignition signals IGt1, IGt2, IGt3, IGt4 is turned on) is inputted to the time width detection circuit 11 and the rising timing detection circuit 12 respectively and such that output signals (an FF-S signal and an FF-R signal) of the circuits 11, 12 are inputted to an S terminal (a set terminal) and an R terminal (reset terminal) of the RS flip-flop 13 respectively. An FF-Q signal outputted from a Q terminal of the RS flip-flop 13 is inputted into a gate of the transistor 14. In the ignition device, the transistor 14 is switched on while the FF-Q signal is in the logically high state (H). In that state, the input of the drive signal Dr2 to the AND circuits (the AND circuits 211, 212, etc.) of the respective cylinders is prohibited (i.e., the drive signal Dr2 is lowered to the ground and fixed to the logically low state (L)). The RS flip-flop 13 is structured such that the output of the Q terminal becomes logically high (H) if the S terminal (set terminal) changes from the logically low state (L) to the logically high state (H) when the R terminal (reset terminal) is in the logically low state (L). The state "Q terminal=logically high (H)" is maintained until the R terminal becomes logically high (H).

Figure 2:
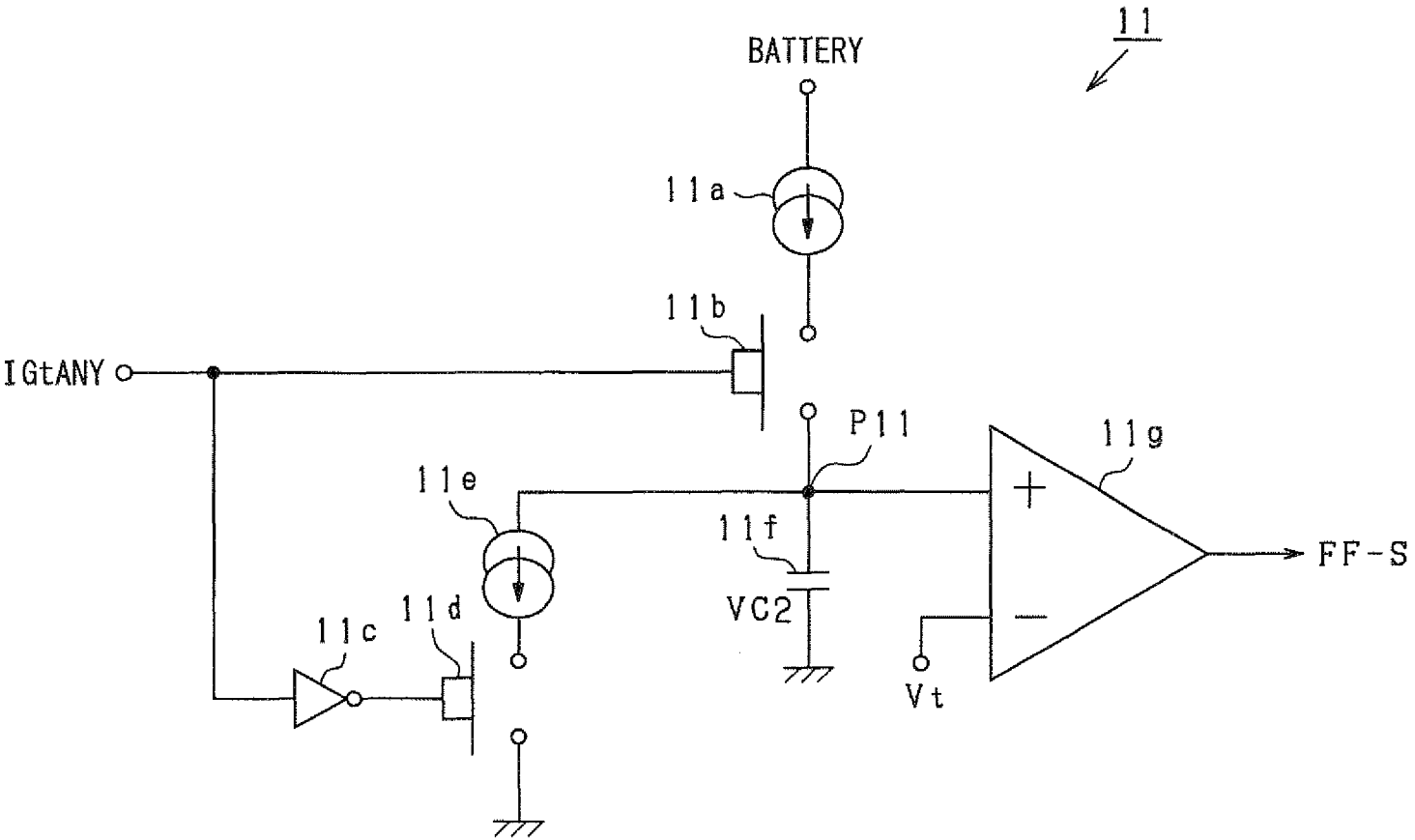
FIG. 2 is a circuit diagram showing the ignition device according to the first embodiment.

FIG. 2 shows details of the structure of the time width detection circuit 11. As shown in FIG. 2, the circuit 11 has a constant current source 11*a*. An end of the constant current source 11*a* is connected to an in-vehicle battery. The other end of the constant current source 11*a* is electrically connected to a parallel circuit of a constant current source 11*e*, a capacitor 11*f*, and a comparator 11*g* (in more detail, a non-inverting input terminal of the comparator 11*g*) through a switching element 11*b*. Among the constant current source 11*e*, the capacitor 11*f*, and the comparator 11*g* connected in parallel with each other, an end of the capacitor 11*f* opposite from the switching element 11*b* is grounded. An end of the constant current source 11*e* opposite from the switching element 11*b* is grounded through a switching element 11*d*.

The non-inverting input terminal of the comparator 11*g* is connected to three electrical pathways via a connection point P11. An electric potential of the non-inverting input terminal (equivalent to an electric potential of the capacitor 11*f*) changes with the states of the respective electrical pathways. In more detail, one is a pathway, to which the switching element 11*b*, the constant current source 11*a*, and the in-vehicle battery are connected in series in this order from the non-inverting input terminal (the connection point P11) side. Another one is a pathway, to which the capacitor 11*f* and the ground are connected in series in this order from the connection point P11 side. The other one is a pathway, to which the constant current source 11*e*, the switching element 11*d*, and the ground are connected in series in this order from the connection point P11 side. A reference electric potential Vt is applied to an inverting input terminal of the comparator 11*g*.

The circuit 11 has the above-described structure such that the ignition signal IGtANY is given to a conduction control terminal of the switching element 11*b* and a logically inversed signal (a signal inversed by an inverter 11*c*) of the ignition signal IGtANY is given to a conduction control terminal of the switching element 11*d* respectively. Thus, the electric potential of the non-inverting input terminal of the comparator 11*g* can be controlled with the ignition signal IGtANY. The comparator 11*g* generates an output by comparing the signal inputted into the non-inverting input terminal and a signal (a reference electric potential Vt) inputted into the inverting input terminal. For example, when the signal of the non-inverting input terminal is equal to or higher than the reference electric potential Vt, the comparator 11*g* outputs the logically high (H) signal as the FF-S signal. When the signal of the non-inverting input terminal is lower than the reference electric potential Vt, the comparator 11*g* outputs the logically low (L) signal as the FF-S signal. The value (the electric potential) of the reference electric potential Vt is set (for example, at a fixed value) such that the electric potential VC2 of the capacitor 11*f* does not exceed the value of the reference electric potential Vt when the ignition in each cylinder is directed at desired timing (i.e., when each of the ignition signals IGt1, IGt2, IGt3, IGt4 falls at the desired timing) and such that the electric potential VC2 of the capacitor 11*f* exceeds the value of the reference electric potential Vt when the ignition in each cylinder is not performed at the desired timing.

Next, an operation of the drive circuit having the multiple ignition control section 201*b* and ignition control by the ignition device according to the present embodiment will be explained also with reference to FIG. 14.

Figure 14:
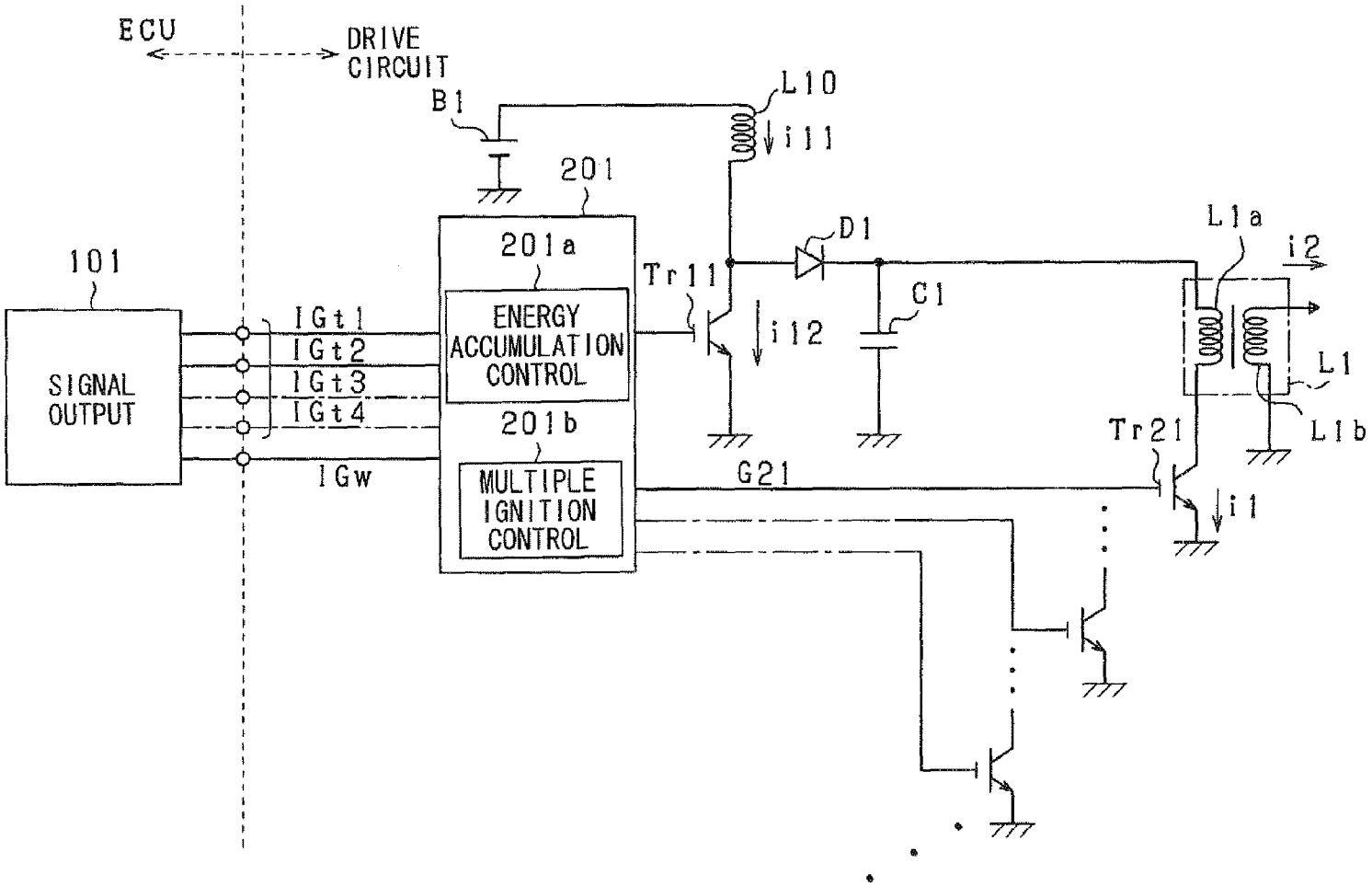
FIG. 14 RELATED ART
FIG. 14 is a circuit diagram showing a multiple electric discharge ignition type ignition device of a related art.

As shown in FIG. 14, like the conventional device described above, the ignition device according to the present embodiment also energizes the primary ignition coil L1*a* by discharging the electric charge accumulated in the capacitor C1 at the timing based on the ignition signal IGt1 and the multiple period signal IGw from the signal output section 101. Thus, the ignition device causes an ignition plug (an ignition plug provided to a combustion chamber of the engine) connected to a secondary ignition coil L1*b* to perform first ignition electric discharge. After that, the ignition device alternately switches on and off the transistor Tr11 and the transistor Tr21 in a constant cycle. Thus, the current flows through the coil L10 and as a result an inductive energy (electrical energy) is accumulated in the coil L10 when the transistor Tr21 is switched off and the transistor Tr11 is switched on. The inductive energy accumulated in the coil L10 is discharged and as a result a current flows through the primary ignition coil L1*a* when the transistor Tr11 is switched off and the transistor Tr21 is switched on. The ignition device causes the electricity to flow through the secondary ignition coil L1*b* in forward and backward directions in a multiple electric discharge period and repeatedly causes the ignition electric discharge in the ignition coil L1 in this way. Thus, the ignition device performs the multiple electric discharge with the ignition plug electrically connected to the ignition coil L1 (in more detail, to the secondary ignition coil L1*b*).

Next, an operation of the ignition device according to the present embodiment will be explained in more detail with reference to FIGS. 3 to 6. Here, specifically paying attention to the ignition in the two cylinders (cylinders #1, #3) among the multiple cylinders, operation modes thereof will be explained. However, fundamentally, the ignition control is performed for the other cylinders (cylinders #2, #4) by the similar operation.

Figure 3:
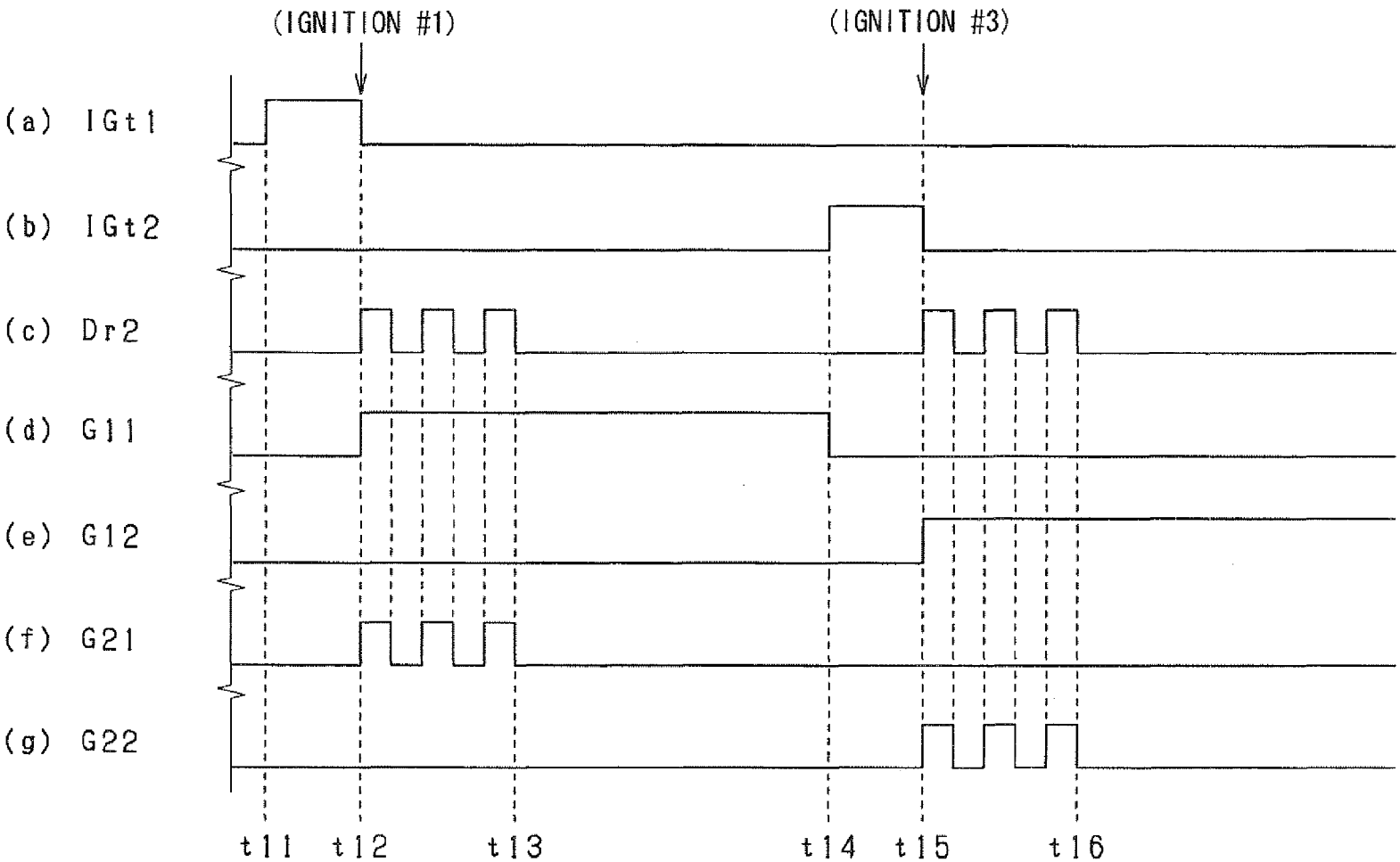
FIG. 3 is a timing chart showing an operation mode of the ignition device according to the first embodiment.

FIG. 3 is a timing chart showing an operation mode of the ignition device according to the present embodiment, paying attention to the signals concerning the energization control of the ignition coil L1 except for the signal concerning the wrong ignition prevention circuit 251. In FIG. 3, part (a) shows a transition of the ignition signal IGt1, part (b) shows a transition of the ignition signal IGt2, parts (c), (d) and (e) respectively show transitions of the drive signal Dr2 and the cylinder determination signals G11, G12 as the input signals of the AND circuits 211, 212, and parts (f) and (g) show transitions of the switching signals G21, G22 for the transistors Tr21, Tr22.

As shown in part (a) of FIG. 3, in this example, the ignition signal IGt1 related to the cylinder #1 is turned on (i.e., becomes logically high (H)) at timing t11 and is turned off (i.e., becomes logically low (L)) at timing t12. At the timing t12 when the ignition signal IGt1 falls, the cylinder determination signal G11 is turned on as shown in part (d) (but the cylinder determination signals related to the other cylinders than the cylinder #1 remain OFF). Since then, the switching signal G21 is turned on and off repeatedly as shown in part (f). Thus, the transistor Tr21 repeatedly alternates between ON and OFF in a predetermined cycle. Thus, the multiple electric discharge in the cylinder #1 is performed in the period from t12 to t13. The cylinder determination signal G11 is held at the logically high state (H) until the ignition signal IGt2 is turned on at timing t14.

Likewise, also in the case of the cylinder #3, if the ignition signal IGt2 related to the cylinder #3 is turned on at the timing t14 and turned off at timing t15, the cylinder determination signal G12 is turned on as shown in part (e) (while the cylinder determination signals corresponding to the cylinders other than the cylinder #3 remain OFF) at the timing t15 when the ignition signal IGt2 falls. Since then, the switching signal G22 is turned on and off repeatedly as shown in part (g). Thus, the transistor Tr22 repeatedly alternates between ON and OFF in a predetermined cycle. Thus, the multiple electric discharge in the cylinder #3 is performed in a period from t15 to t16.

Figure 4:
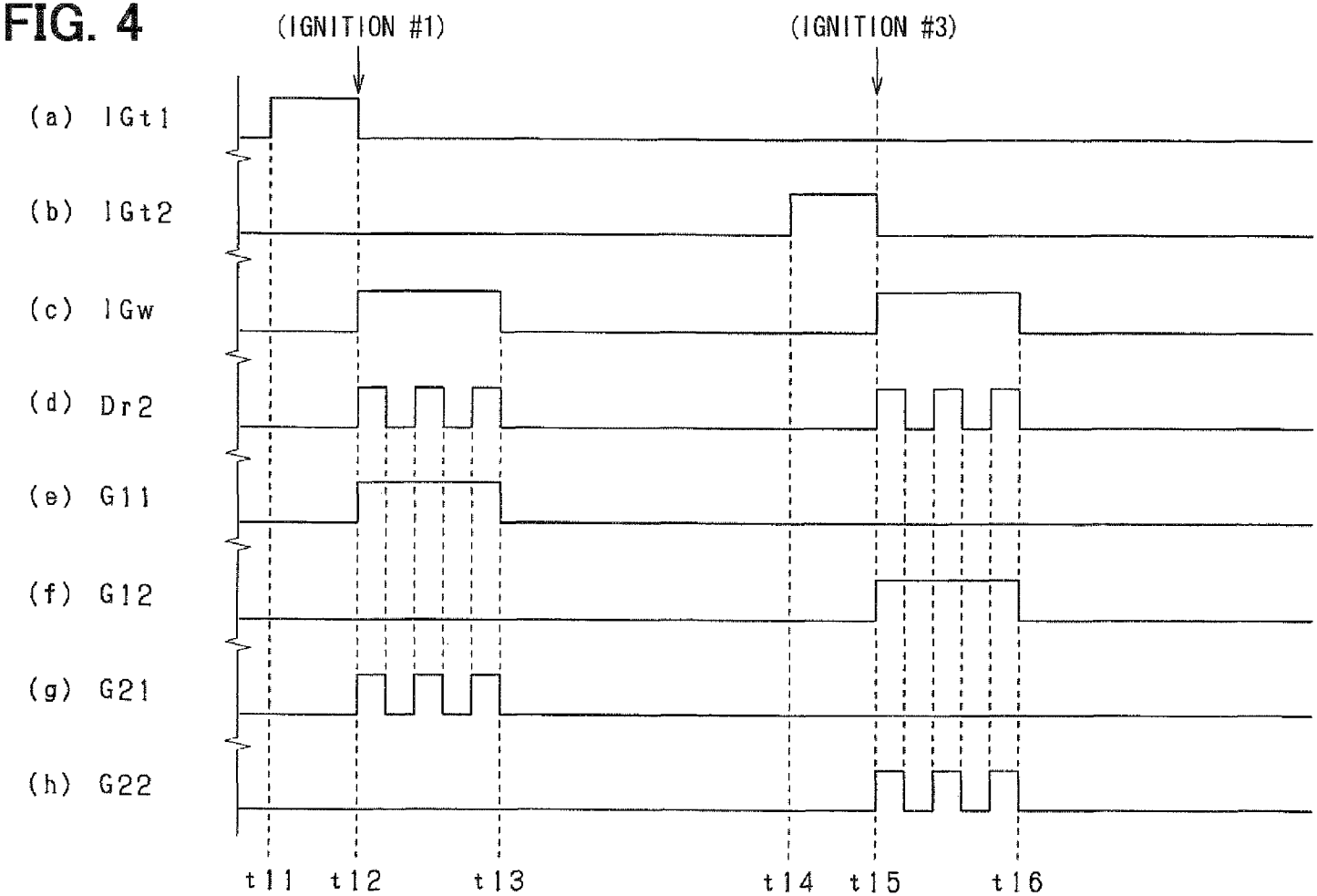
FIG. 4 is a timing chart showing another operation mode of the ignition device according to the first embodiment.

FIG. 4 is a timing chart showing another operation mode of the ignition device according to the present embodiment. Parts (a) and (b) of FIG. 4 correspond to parts (a) and (b) of FIG. 3 and parts (d) to (h) of FIG. 4 correspond to parts (c) to (g) of FIG. 3. Part (c) of FIG. 4 shows a transition of the multiple period signal IGw.

As shown in FIG. 4, fundamental operation of this example is the same as that of the example shown in FIG. 3. However, in the example of FIG. 4, the cylinder determination signals G11, G12 are turned on and off based on the multiple period signal IGw. Also in the example of FIG. 4, the multiple electric discharge in the respective cylinders is performed in the periods t12-t13, t15-t16, etc.

Figure 5:
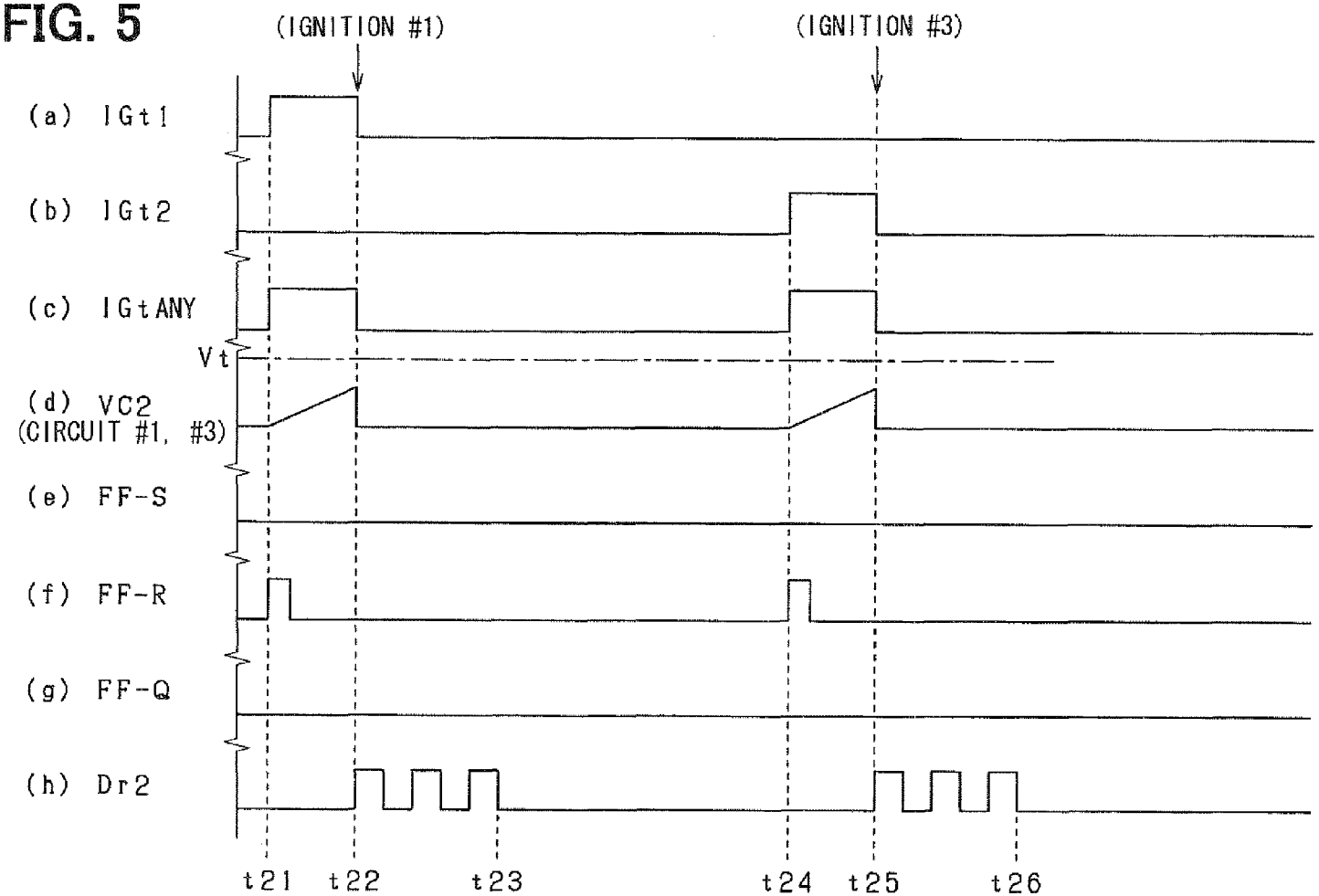
FIG. 5 is a timing chart showing another operation mode of the ignition device according to the first embodiment.
Figure 6:
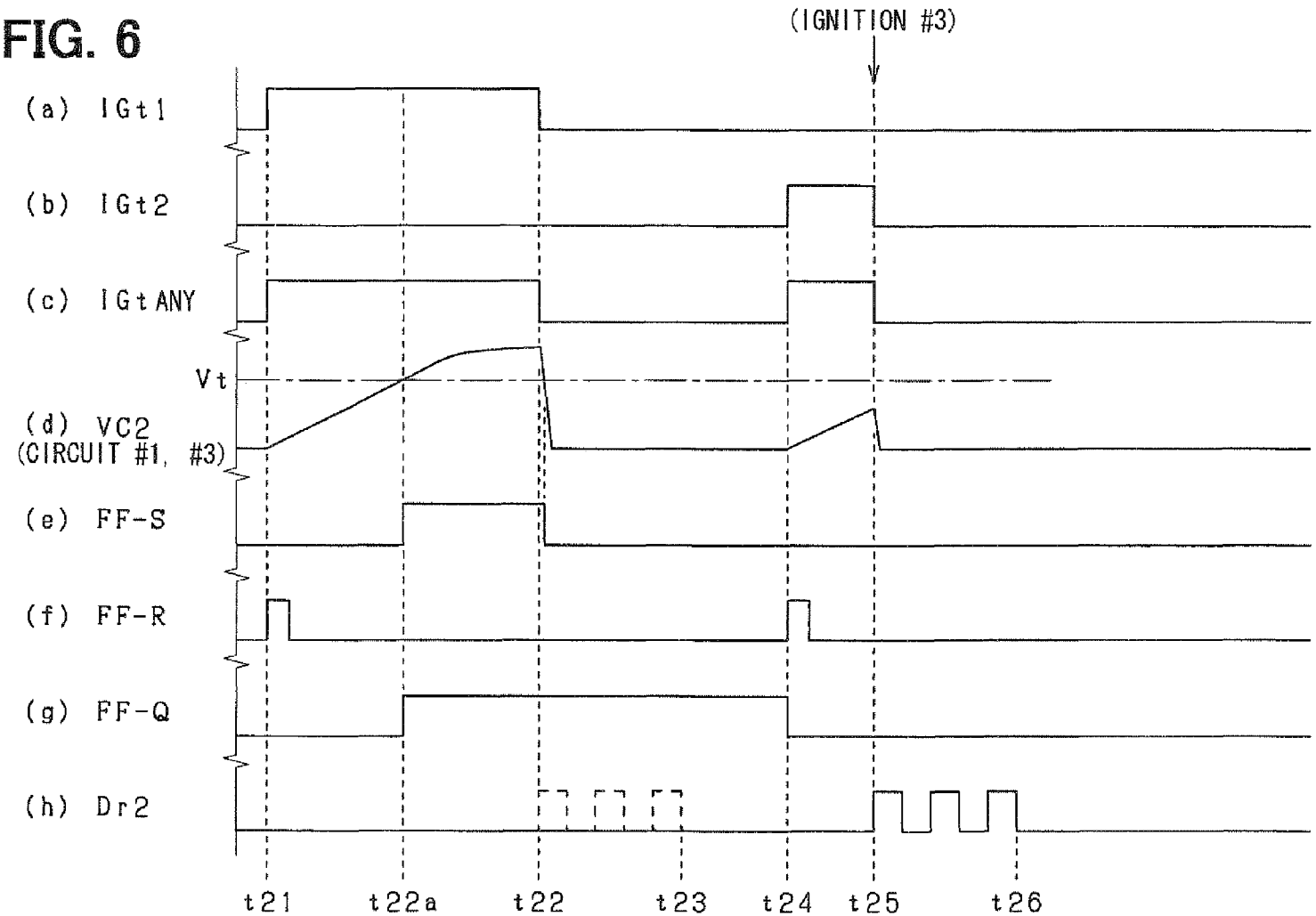
FIG. 6 is a timing chart showing yet another operation mode of the ignition device according to the first embodiment.

Next, with reference to FIGS. 5 and 6, the operation of the ignition device according to the present embodiment will be further explained by comparing the case where the ignition by the ignition device according to the present embodiment is directed at the normal timing (desired timing) and the case where the ignition is directed at the abnormal timing (timing delayed from the desired timing).

First, with reference to FIG. 5, the case where the ignition by the ignition device according to the present embodiment is directed at the normal timing will be explained. FIG. 5 is a timing chart showing an operation mode of the ignition device according to the present embodiment, paying attention to the signal concerning the wrong ignition prevention circuit 251 among the signals concerning the energization control of the ignition coil L1. In FIG. 5, part (a) shows a transition of the ignition signal IGt1, part (b) shows a transition of the ignition signal IGt2, part (c) shows a transition of the ignition signal IGtANY (i.e., the signal turned on when any one of the ignition signals IGt1-IGt4 is turned on), part (d) shows a transition of the electric potential VC2 of the capacitor 11*f* (shown in FIG. 2), parts (e), (f) and (g) respectively show transitions of the FF-S signal, the FF-R signal and the FF-Q signal of the RS flip-flop 13, and part (h) shows a transition of the drive signal Dr2.

In this example, the ignition signal IGtANY is turned on (i.e., becomes logically high (H)) at timing t21 as shown in part (c) of FIG. 5. A reset signal (in more detail, a one-shot signal of "FF-R signal=logically high (H)") is inputted to the R terminal of the RS flip-flop 13 (shown in FIG. 1) at timing t21 as shown in part (f). Then, the ignition signal IGtANY is turned off (i.e., becomes logically low (L)) at following timing t22. In a period from t21 to t22, the switching element 11*b* shown in FIG. 2 is held at the ON state, and the capacitor 11*f* is charged with the battery.

In this example, as shown in part (a) of FIG. 5, the ignition in the cylinder #1 is performed at the normal timing t22 (i.e., the ignition signal IGt1 falls at the normal timing t22), and as shown in part (h) of FIG. 5, the multiple electric discharge in the cylinder #1 is performed in a period from t22 to t23. In this case, the electric potential VC2 of the capacitor 11*f* does not exceed the value of the reference electric potential Vt as shown in part (d) of FIG. 5.

Also in the case of the cylinder #3, the ignition signal IGt2 concerning the cylinder #3 is turned on at timing t24 and turned off at normal timing t25. Thus, the multiple electric discharge in cylinder #3 is performed in a period from t25 to t26.

Next, the case where the ignition (specifically, the ignition in the cylinder #1) by the ignition device according to the present embodiment is directed at the abnormal timing will be explained with reference to FIG. 6. Parts (a) to (h) of FIG. 6 respectively correspond to parts (a) to (h) of FIG. 5.

As shown in FIG. 6, in this example, the ignition signal IGt1 is outputted for an abnormally long time, and the ignition in the cylinder #1 is directed at abnormal timing t22 (i.e., at timing delayed from desired start timing t22*a*). Accordingly, as shown in part (d) of FIG. 6, the electric potential VC2 of the capacitor 11*f* exceeds the value of the reference electric potential Vt, and the output (FF-S signal) of the comparator 11*g* (shown in FIG. 2) becomes logically high (H) at the timing t22*a* when the electric potential VC2 exceeds the reference electric potential Vt. Thus, when the FF-S signal becomes logically high (H), the FF-Q signal of the RS flip-flop 13 also becomes logically high (H), and the transistor 14 is switched on based on the FF-Q signal. While the transistor 14 is ON (until the reset signal is inputted into the R terminal of the RS flip-flop 13 next time), the input of the drive signal Dr2 to the AND circuits (the AND circuits 211, 212, etc.) of the respective cylinders is prohibited (i.e., fixed to the logically low (L) state). As a result, energization to the ignition coils of the respective cylinders, i.e., execution of the ignition in the respective cylinders, is prohibited (simultaneously in all of the four cylinders).

The prohibition is removed when the reset signal is inputted into the R terminal of the RS flip-flop 13 before the ignition control of the cylinder #3 as the next target cylinder. Therefore, when the ignition in the cylinder #3 is directed at the normal timing t25 as shown in part (b) of FIG. 6, the multiple electric discharge in the cylinder #3 is performed in the period from t25 to t26 as usual as shown in part (h) of FIG. 6.

The ignition device of the internal combustion engine according to the present embodiment described above exerts following outstanding effects, for example.

(1) The ignition device (the ECU and the drive circuit) for a spark ignition type internal combustion engine, which directs the ignition by the generation of the predetermined start signal (i.e., the falling of each of the ignition signals IGt1, IGt2, IGt3, IGt4), has the circuit that monitors the generating timing of the start signal and that prohibits the ignition based on the start signal when the start signal occurs at the abnormal timing (for example, timing other than the timing t22*a* shown in FIG. 6). For example, the ignition device according to the above embodiment has the circuit (a timing determination device: the circuits 11, 12 and the RS flip-flop 13 shown in FIG. 1) that determines whether the above-described start signal occurs at the predetermined start timing (for example, the timing t22*a* shown in FIG. 6) and the circuit (a prohibition device: the transistor 14 shown in FIG. 1) that prohibits the ignition based on that start signal when the above circuit determines that the start signal does not occur at the above-described start timing. Thus, when the start signal (the falling of each of the ignition signals IGt1, IGt2, IGt3, IGt4) occurs at abnormal timing, the ignition at the abnormal timing based on the start signal can be prohibited, thereby reducing the damage to the engine, the peripheral devices and the like resulting from the abnormal ignition.

(2) The above-described start timing is set at the timing (for example, the timing t22*a* shown in FIG. 6) when a predetermined time (for example, the time from t21 to t22*a* shown in FIG. 6) has elapsed after the timing (for example, the timing t21 shown in FIG. 5 or 6) when the predetermined reference signal (i.e., the rising of each of the ignition signals IGt1, IGt2, IGt3, IGt4) occurs. The time width detection circuit 11 (shown in FIG. 2) determines whether the start signal is generated at the above-described start timing based on the time (for example, the time from t21 to t22 equivalent to the pulse width shown in FIG. 5 or 6) since the above-described reference signal is generated until the start signal is generated. With such the construction, it is easily and appropriately determined whether the above-described start signal is generated at the start timing based on the time from the generation of the reference signal to the generation of the start signal.

(3) The time width detection circuit 11 (shown in FIG. 2) starts charging the timer capacitor (the capacitor 11*f* shown in FIG. 2) at the timing of the generation of the above-described reference signal (for example, the timing t21 shown in FIG. 5 or 6). The time width detection circuit 11 determines whether the start signal is generated at the above-described start timing based on whether the changed amount of the timer capacitor exceeds the permissible level (i.e., whether the electric potential VC2 exceeds the value of the reference electric potential Vt) before the above-described start signal occurs. Thus, it can be determined easily and appropriately whether the start signal is generated at the start timing based on the charged amount of the capacitor 11*f*.

(4) The time width detection circuit 11 (shown in FIG. 2) determines whether the start signal is generated at the start timing based on the magnitude (the logically high (H) state or the logically low (L) state) of the output electric potential (the FF-S signal) of the comparator 11*g*, to which the electric potential VC2 equivalent to the charged amount of the capacitor 11*f* and the specified electric potential (the reference electric potential Vt) equivalent to the above-described permissible level are inputted. Thus, the above-described determination can be performed easily and appropriately with a well-known circuit.

(5) The reset signal (the FF-R signal) is inputted into the RS flip-flop 13 when the above-described reference signal occurs (for example, at the timing t21 shown in FIG. 5 or 6). The set signal (the FF-S signal) is inputted from the time width detection circuit 11 (shown in FIG. 2) to the RS flip-flop 13 when the time (for example, the time from t21 to t22 equivalent to the pulse width shown in FIG. 5 or 6) from the generation of the reference signal to the generation of the start signal exceeds the permissible level (for example, the time from t21 to t22*a* shown in FIG. 6). The determination result of whether the above-described start signal (i.e., the falling of each of the ignition signals IGt1, IGt2, IGt3, IGt4) is generated at the predetermined start timing (for example, the timing t22*a* of FIG. 6) is outputted as the output (the FF-Q signal) of the RS flip-flop 13. Thus, the above-described determination can be performed easily and appropriately with a well-known circuit.

(6) The ignition directed by the generation of the above-described start signal (the failing of each of the ignition signals IGt1, IGt2, IGt3, IGt4) is performed as the multiple electric discharge ignition of performing the ignition multiple times intermittently. The ignition device has the program (mounted in the ECU) for outputting the multiple period signal IGw indicating the period (for example, the period from t12 to t13 shown in FIG. 4) for continuously performing the multiple electric discharge ignition in accordance with the generation of the start signal (for example, the falling of the ignition signal IGt1 shown in FIG. 4), the circuit (the AND circuit 210 shown in FIG. 1) for outputting the pulse signal (the drive signal Dr2) directing the above-described multiple electric discharge ignition during the output of the multiple period signal IGw, and the circuit (the AND circuits 211, 212, etc., the transistors Tr21, Tr22, etc., the ignition coils L1, etc. shown in FIG. 1 and the like) for performing the above-described multiple electric discharge ignition based on the drive signal Dr2 during the output of the drive signal Dr2. The transistor 14 (shown in FIG. 1) prohibits the output of the drive signal Dr2 (i.e., fixes the drive signal Dr2 to the logically low (L) state) when the circuits 11, 12 and the RS flip-flop 13 determine that the start signal is not generated at the start timing (i.e., when the signal of the logically high (H) state is outputted as the FF-Q signal from the RS flip-flop 13). Accordingly, the ignition at the abnormal timing can be appropriately prohibited while realizing the multiple electric discharge ignition.

(7) The internal combustion engine performs the ignition by energizing the ignition plug. The energization and the de-energization of the ignition plug switch in accordance with the ON/OFF state of the ignition switch (each of the transistors Tr21, Tr22, etc.) as the prescribed switching element. The ignition device has the switch control circuit (the multiple ignition control section 201*b* shown in FIG. 1) that switches the ON/OFF state of the above-described ignition switch based on predetermined parameters (the multiple period signal IGw, the drive signal Dr1, and the ignition signal IGtANY shown in FIG. 1). Thus, the above-described structure can be realized easily and appropriately with a well-known circuit.

(8) The ignition device has the circuit (a signal determination device: the AND circuits 211, 212, etc. shown in FIG. 1) that determines whether both of the switch signal (the drive signal Dr2) indicating the ON/OFF mode of the above-described ignition switch (each of the transistors Tr21, Tr22, etc.) and the above-described start signal (the falling of each of the ignition signals IGt1, IGt2, IGt3, IGt4) are generated. The above-described ignition switch is the normally-off type switching element. The above-described switch control circuit switches the ON/OFF state of the above-described ignition switch in the ON/OFF mode corresponding to the above-described drive signal Dr2 when each of the AND circuits 211, 212, etc. shown in FIG. 1 determines that both of the above-described signals are generated (i.e., when the signal of the logically high (H) state is outputted by each of the AND circuits 211, 212, etc.). When the above-described prohibition is performed, the transistor 14 (shown in FIG. 1) invalidates the drive signal Dr2 and causes each of the above-described AND circuits 211, 212, etc. to output the logically low (L) signal. With such the structure, the ignition at the abnormal timing can be prohibited appropriately.

(9) The ignition device has the ignition coil L1 that has the primary coil (the primary ignition coil L1*a*) and the secondary coil (the secondary ignition coil L1*b*) and that controls the energization/de-energization of the ignition plug. The circuit structure is provided such that in the ignition coil, the energization/de-energization of the primary ignition coil L1*a* is switched in accordance with the ON/OFF state of the above-described ignition switch (each of the transistors Tr21, Tr22, etc.) and the secondary ignition coil L1*b* is provided in the energization route of the ignition plug. With such the structure, the energization/de-energization of the ignition plug can be suitably controlled.

(10) The ignition device has the circuit (a multiple electric discharge performing device; the AND circuits 211, 212, etc. shown in FIG. 1) that repeatedly switches on and off the above-described ignition switch (each of the transistors Tr21, Tr22, etc.) based on the generation of the above-described start signal (the falling of each of the ignition signals IGt1, IGt2, IGt3, IGt4) to cause the primary current to flow through the primary ignition coil L1*a* intermittently. Thus, the circuit repeatedly generates the secondary current in the secondary ignition coil L1*b* to cause the ignition plug to perform the multiple electric discharge. With such the construction, the multiple electric discharge ignition can be realized appropriately.

(11) The ignition switch (each of the transistors Tr21, Tr22, etc.) is connected in series with each of the primary ignition coils L1*a*, etc., and the prescribed ignition capacitor (each of the capacitors C1, etc. shown in FIG. 14) is connected in parallel with each of the primary ignition coils L1*a*, etc. If the above-described ignition switch is switched on, each of the primary ignition coils L1*a*, etc. receives the supply of the electric charge accumulated in corresponding one of the capacitors C1, etc. With such the structure, sufficiently high voltage can be easily and appropriately applied to each of the primary ignition coils L1*a*, etc.

(12) When the above-described prohibition is not performed (when the transistor 14 is not ON), the transistor 14 (shown in FIG. 1) allows the above-described ignition switch (each of the transistors Tr21, Tr22, etc.) to be switched on by the generation of the above-described start signal (the falling of each of the ignition signals IGt1, IGt2, IGt3, IGt4). The transistor 14 does not allow the above-described ignition switch to be switched on when the above-described prohibition is performed (when the transistor 14 is ON) even if the above-described start signal is generated. With such the construction, the ignition at the abnormal timing can be prohibited appropriately.

(13) When the above-described prohibition is performed (i.e., when the transistor 14 is ON), the transistor 14 (shown in FIG. 1) prohibits switching on of the above-described ignition switch by means of the circuit. With such the construction, the above-described prohibition can be performed surely as compared to the case where the above-described prohibition is performed by means of the software (the program).

(14) The above-described ignition switch (each of the transistors Tr21, Tr22, etc.) is the normally-off type transistor that is switched on if the logically high (H) electric potential is applied to the gate thereof. The transistor 14 (shown in FIG. 1) fixes the electric potential of the gates of the transistors Tr21, Tr22, etc. to the logically low (L) electric potential when the above-described prohibition is performed (when the transistor 14 is ON). With such the construction, the above-described prohibition can be realized easily and appropriately.

(15) The ignition device is used for the multi-cylinder engine (in more detail, the in-line four-cylinder engine) having the multiple cylinders (four cylinders) and has the circuit (the cylinder determination circuits 221, 222, etc., the AND circuits 211, 212, etc., the transistors Tr21, Tr22, etc., the ignition coils L1, etc., and the like shown in FIG. 1) that determines the target cylinder supposed to perform the ignition at the time among the cylinders and that performs the ignition in the target cylinder based on the above-described start signal (the falling of each of the ignition signals IGt1, IGt2, IGt3, IGt4) when the prohibition by the above-described transistor 14 is not performed (i.e., when the transistor 14 is not ON). The above-described circuits 11, 12 and the RS flip-flop 13 (shown FIG. 1) determine whether the above-described start signal is generated at the predetermined start timing in the target cylinder. When the above-described circuits 11, 12 and the RS flip-flop 13 determine that the start signal is not generated at the above-described start timing (i.e., when the logically low (L) signal is outputted from the RS flip-flop 13 as the FF-Q signal), the above-described transistor 14 (shown in FIG. 1) prohibits the ignition based on the above-described start signal in all of the four cylinders including the target cylinder relating to the above determination. With such the construction, the above-described prohibition is suitably realized in the multi-cylinder engine.

Next, an ignition device according to a second embodiment of the present invention having a structure similar to the ignition device shown in FIG. 1 will be described with reference to FIGS. 7 to 9. The present embodiment will be described centering on differences from the first embodiment.

First, an outline construction of the ignition device according to the present embodiment will be explained with reference to FIG. 7. FIG. 7 is a circuit diagram corresponding to FIG. 1. The same sign is used for the same element shown in both of FIGS. 1 and 7.

Figure 7:
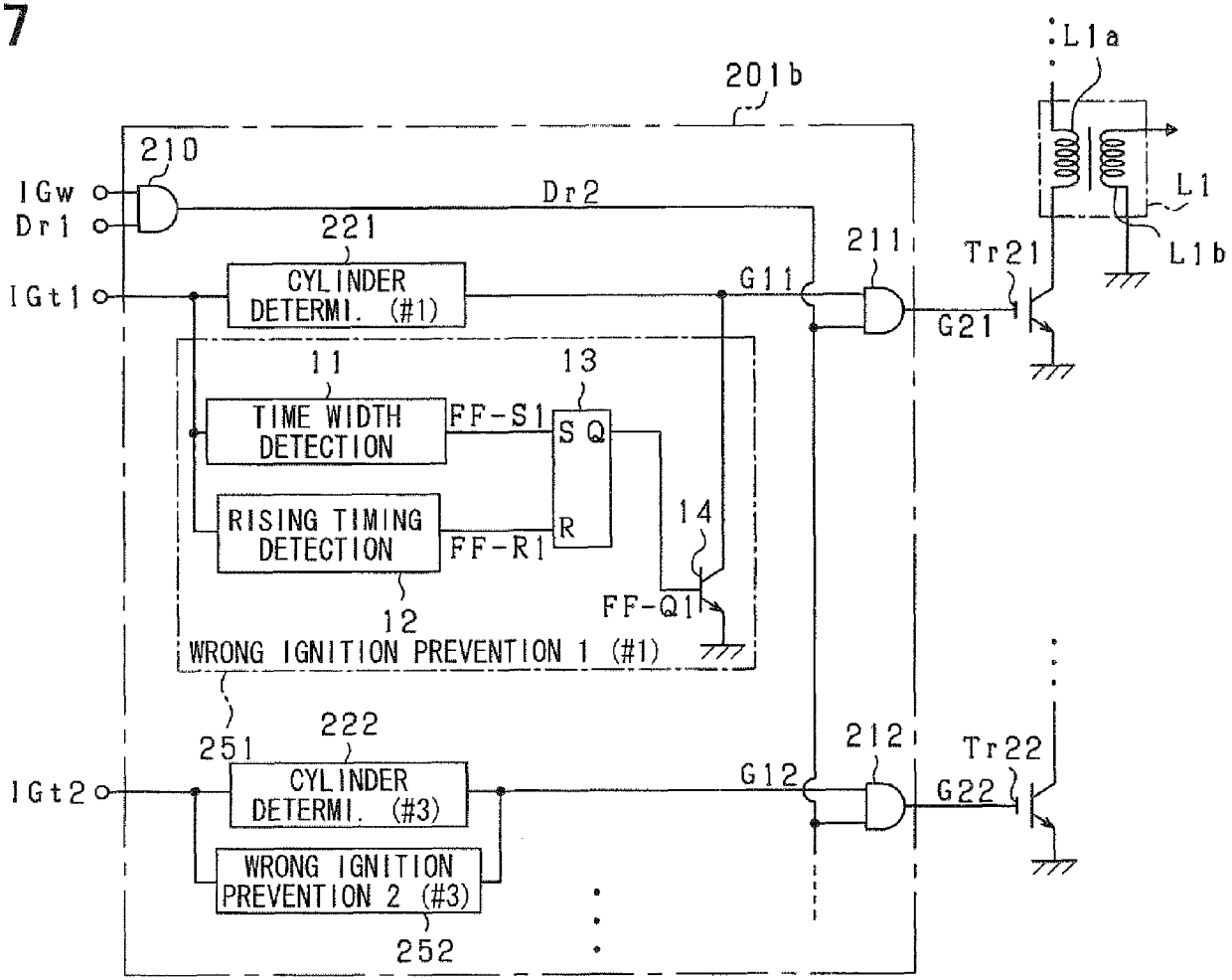
FIG. 7 is a circuit diagram showing an ignition device for an internal combustion engine according to a second embodiment of the present invention.

As shown in FIG. 7, the ignition device according to the present embodiment has the above-described wrong ignition prevention circuits 251, 252, etc. for the cylinder determination signals G11, G12, etc. of the respective cylinders among the inputs to the AND circuits (the AND circuits 211, 212, etc.) of the respective cylinders. The wrong ignition prevention circuits 251, 252, etc, are prepared to the respective cylinders. The wrong ignition prevention circuits 251, 252, etc. related to the cylinder #1, #3, etc. fundamentally have constructions similar among the cylinders. Here, paying attention to the construction of the wrong ignition prevention circuit 251, explanation about the construction of the wrong ignition prevention circuit will be given.

For example, the circuit 251 has the time width detection circuit 11, the rising timing detection circuit 12, the RS flip-flop 13, and the transistor 14 like the device according to the first embodiment (refer to FIG. 2 for the detailed construction). However, the circuit 251 according to the present embodiment is structured such that the ignition signal IGt1 (or the ignition signal IGt2 for the circuit 252) is inputted also into the time width detection circuit 11 and the rising timing detection circuit 12 respectively in addition to the cylinder determination circuit 221. When the transistor 14, which is switched on and off in accordance with an FF-Q1 signal of the RS flip-flop 13, is switched on, the input of the cylinder determination signal G11 (the cylinder determination signal G12 for the circuit 252) to the above-described AND circuit 211 and eventually the on-drive of the transistor Tr21 (the transistor Tr22 for the circuit 252) are prohibited (i.e., lowered to the ground into the logically low (L) state).

Figure 8:
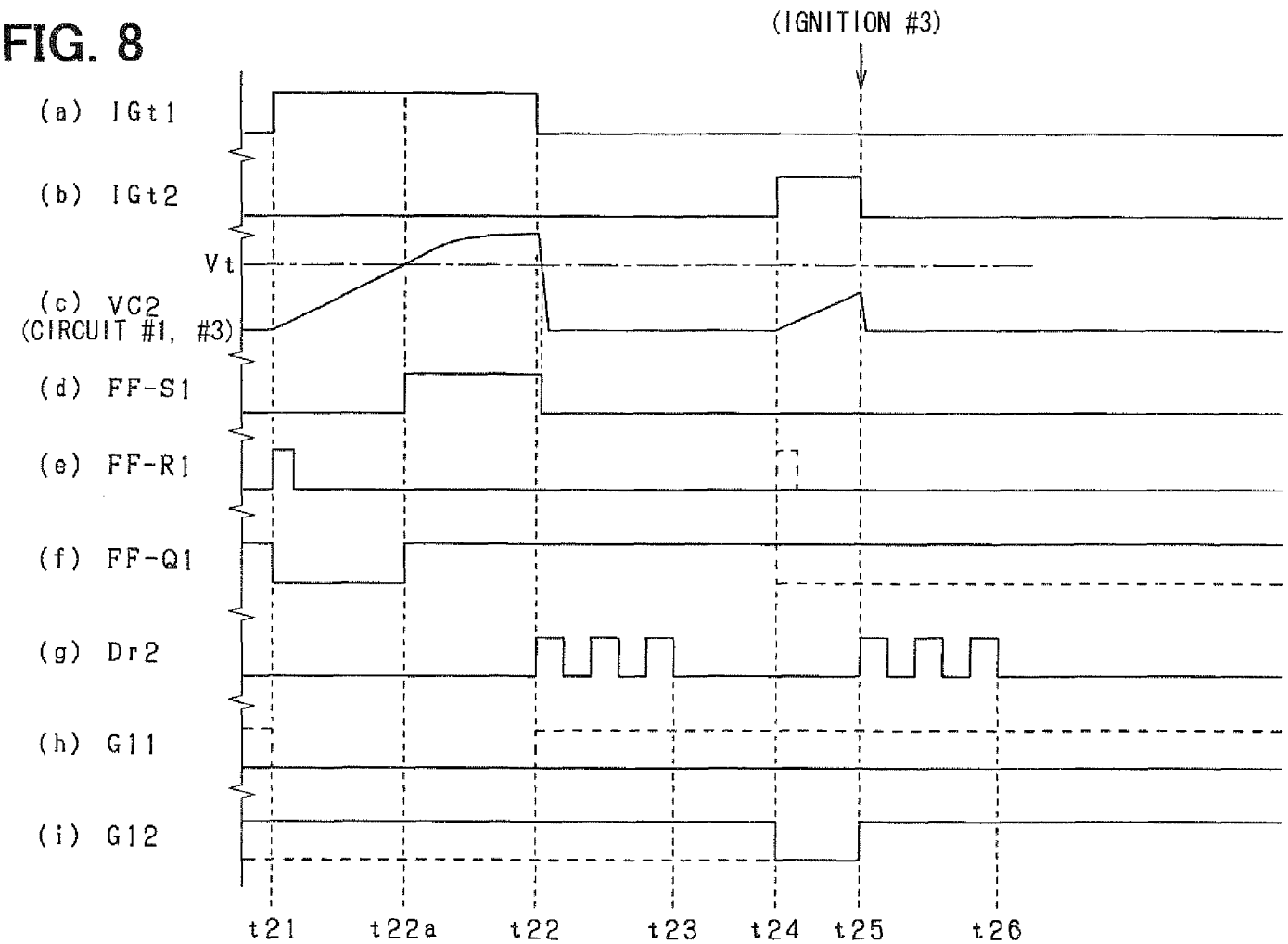
FIG. 8 is a timing chart showing an operation mode of the ignition device according to the second embodiment.
Figure 9:
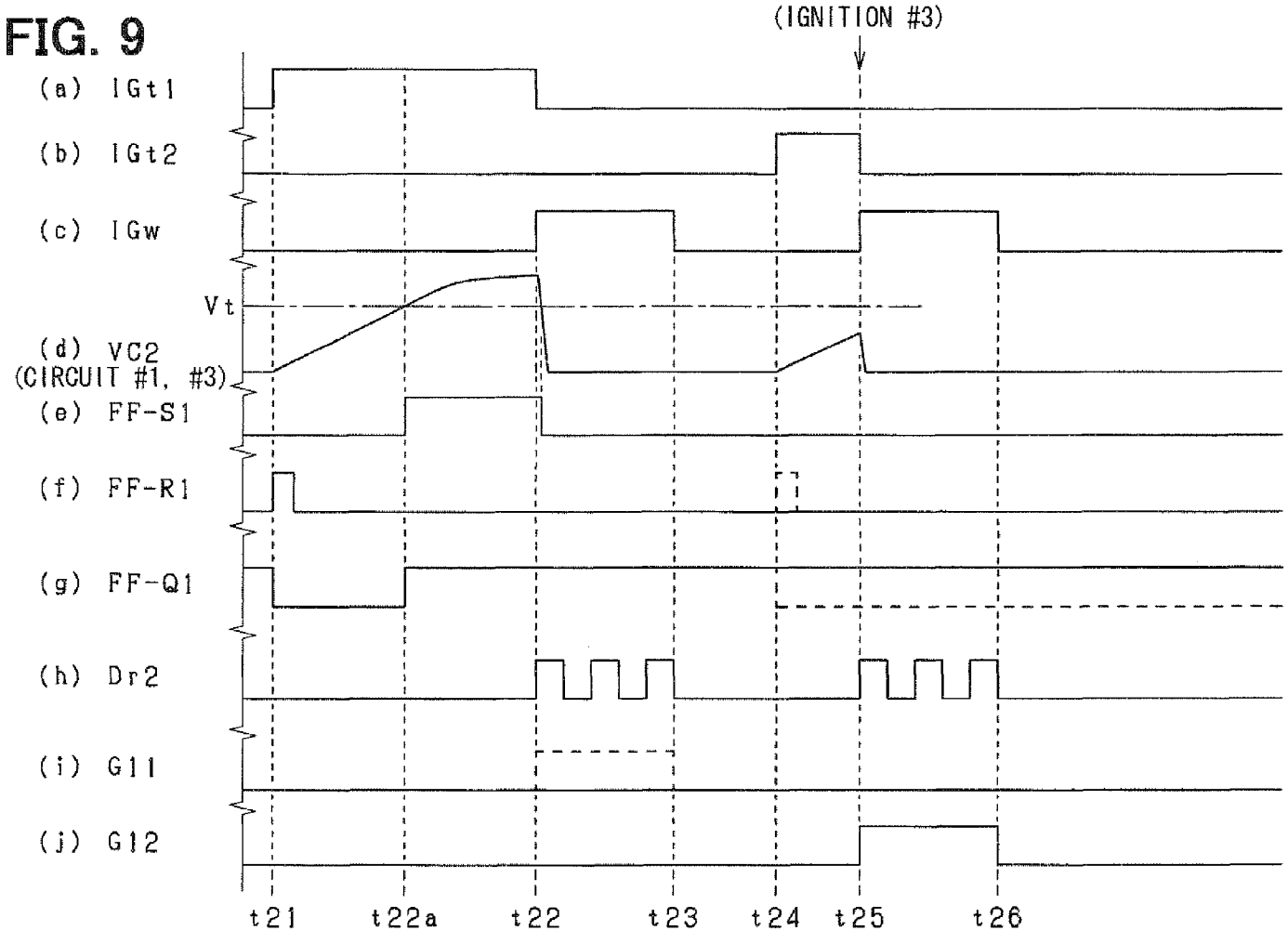
FIG. 9 is a timing chart showing another operation mode of the ignition device according to the second embodiment.

Next, with reference to FIGS. 8 and 9, an operation of the ignition device according to the present embodiment will be further explained by comparing the case where the ignition by the ignition device according to the present embodiment is directed at the normal timing (desired timing) and the case where the ignition is directed at the abnormal timing (timing delayed from the desired timing). FIG. 8 is a timing chart showing an operation mode of the ignition device of the type shown in FIG. 3 applied with the wrong ignition prevention circuit according to the present embodiment. FIG. 9 is a timing chart showing an operation mode of the ignition device of the type shown in FIG. 4 applied with the wrong ignition prevention circuit according to the present embodiment.

First, with reference to FIG. 8, the operation mode of the ignition device of the type shown in FIG. 3 will be explained. In FIG. 8, part (a) shows a transition of the ignition signal IGt1, part (b) shows a transition of the ignition signal IGt2, part (c) shows a transition of the electric potential VC2 of the capacitor 11*f* (shown in FIG. 2) related to the wrong ignition prevention circuit 251, parts (d), (e) and (f) respectively show transitions of an FF-S1 signal, an FF-R1 signal and the FF-Q1 signal of the RS flip-flop 13, part (g) shows a transition of the drive signal Dr2, and parts (h) and (i) show the cylinder determination signals G11, G12 as the input signals of the AND circuits 211, 212 respectively.

In this example, the ignition signal IGt1 is turned on (i.e., becomes logically high (H)) at timing t21 as shown in part (a) of FIG. 8. A reset signal (in more detail, a one-shot signal of "FF-R signal=logically high (H)") is inputted to the R terminal of the RS flip-flop 13 (shown in FIG. 7) as shown in part (e) of FIG. 8. Then, the ignition signal IGt1 is turned off (i.e., becomes logically low (L)) at following timing t22. In the period from t21 to t22, the switching element 11*b* shown in FIG. 2 is held at the ON state, and the capacitor 11*f* is charged with the battery.

In this example, as shown in part (a) of FIG. 8, the ignition in the cylinder #1 is directed at the abnormal timing t22 (timing delayed from desired timing). Accordingly, the electric potential VC2 (the charged amount) of the capacitor 11*f* exceeds the value of the reference electric potential Vt as shown in part (c) of FIG. 8 and the output (the FF-S1 signal) of the comparator 11*g* (shown in FIG. 2) becomes logically high (H) as shown in part (d) of FIG. 8. Because the FF-S1 signal of the RS flip-flop 13 thus becomes logically high (H), the FF-Q1 signal becomes logically high (H) and the transistor 14 is switched on. While the transistor 14 is switched on (i.e., until the reset signal is inputted into the R terminal of the RS flip-flop 13 relating to the circuit 251 next time), the input of the cylinder determination signal G11 to the AND circuit (the AND circuit 211) of cylinder #1 is prohibited (i.e., fixed to the logically low (L) state). Eventually, the energization to the ignition coil of the cylinder #1, i.e., the execution of the ignition in the cylinder #1, is prohibited (for each cylinder individually). The prohibition of the input of the cylinder determination signal G11 relating to the cylinder #1 is not removed as shown by a broken line in part (h) of FIG. 8 even if there occurs the reset signal of the RS flip-flop concerning the circuit 252 (the circuit for the cylinder #3). The ignition device according to the present embodiment facilitates the individual management of the state of each cylinder (specifically, information concerning abnormalities and failures) with such the construction.

Ignition control of the cylinder #3 as the next target cylinder is performed separately from the ignition control of the cylinder #1. That is, even if the ignition in the cylinder #1 is prohibited by the immediately preceding ignition control, the ignition in the cylinder #3 is not prohibited by the prohibition in the cylinder #1. The illustrated example assumes the case where the ignition in the cylinder #3 is directed at the normal timing in the last ignition control for the cylinder #3. Accordingly, as shown by a solid line in part (i) of FIG. 8, the reset signal is inputted into the R terminal of the RS flip-flop of the circuit 252 before the ignition control of the cylinder #3, or in more detail, at the rising timing t24 of the ignition signal IGt2. Thus, the cylinder determination signal G12 becomes logically low (L). A broken line in part (i) assumes the case where the ignition of the cylinder #3 by the immediately preceding ignition control is directed at the abnormal timing. In this case, the cylinder determination signal G12 is maintained in the logically low (L) state. The ignition in the cylinder #3 is directed at the normal timing t25 in the present ignition control. Therefore, as shown in part (c) of FIG. 8, the electric potential VC2 of the capacitor 11*f* (shown in FIG. 2) concerning the circuit 252 does not exceed the value of the reference electric potential Vt, and the multiple electric discharge in the cylinder #3 is performed in the period from t25 to t26 as usual (as the normal control).

Next, an operation mode of the ignition device of the type shown in FIG. 4 will be explained with reference to FIG. 9. Parts (a) and (b) of FIG. 9 correspond to parts (a) and (b) of FIG. 8. Parts (d) to (j) of FIG. 9 correspond to parts (c) to (i) of FIG. 8. Pad (c) of FIG. 9 shows a transition of the multiple period signal IGw.

The fundamental operation of the example shown in FIG. 9 is similar to that of the example shown in FIG. 8. However, in the example of FIG. 9, the cylinder determination signals G11, G12 are turned on and off based on the multiple period signal IGw. Also in this case, when the ignition in each cylinder is directed at the abnormal timing, the input of the cylinder determination signal to the AND circuit of the cylinder is prohibited (i.e., fixed to the logically low (L) state). Eventually, the execution of the ignition in the cylinder is prohibited (for each cylinder individually).

As explained above, the ignition device of the internal combustion engine according to the present embodiment exerts following effects in addition to the effects (1)-(7) and (9)-(14) of the first embodiment or similar effects.

(16) The ignition device has the circuit (a signal determination device: the AND circuits 211, 212, etc. shown in FIG. 7) that determines whether both of the switch signal (the drive signal Dr2) indicating the ON/OFF mode of the above-described ignition switch (each one of the transistors Tr21, Tr22, etc.) and the above-described start signal (the falling of each of the ignition signals IGt1, IGt2, IGt3, IGt4) are generated. The above-described ignition switch is the normally-off type switching element. The above-described switch control circuit switches the ON/OFF state of the above-described ignition switch in the ON/OFF mode corresponding to the above-described drive signal Dr2 when each of the AND circuits 211, 212, etc. shown in FIG. 7 determines that both of the above-described signals are generated (i.e., when the logically high (H) signal is outputted by each of the AND circuits 211, 212, etc.). When the above-described prohibition is performed, the transistor 14 (shown in FIG. 7) invalidates the above-described start signal (the falling of each one of the ignition signals IGt1, IGt2, IGt3, IGt4) to cause each one of the above-described AND circuits 211, 212, etc to output the logically low (L) signal. With such the construction, the ignition at the abnormal timing can be prohibited appropriately.

(17) The ignition device is used for the multi-cylinder engine (in more detail, the in-line four-cylinder engine) having the four cylinders and has the circuit (the cylinder determination circuits 221, 222, etc., the AND circuits 211, 212, etc., the transistors Tr21, Tr22, etc., the ignition coils L1, etc. and the like shown in FIG. 7) for determining the target cylinder that should perform the ignition at the time among the cylinders and for performing the ignition in the target cylinder based on the above-described start signal (the falling of each of the ignition signals IGt1, IGt2, IGt3, IGt4) when the prohibition by the above-described transistor 14 is not performed (i.e., when the transistor 14 is not switched on). The above-described circuits 11, 12 and the RS flip-flop 13 (shown in FIG. 7) determine whether the above-described start signal is generated at the predetermined start timing in the target cylinder. When the above-described circuits 11, 12 and the RS flip-flop 13 determine that the start signal is not generated at the above-described start timing (i.e., when the logically low (L) signal is outputted from the RS flip-flop 13 as the FF-Q signal), the above-described transistor 14 (shown in FIG. 7) prohibits the ignition based on the above-described start signal only in the target cylinder related to the determination. With such the construction, the above-described prohibition can be suitably realized for each cylinder of the multi-cylinder engine.

Next, an ignition device according to a third embodiment of the present invention having a structure similar to the ignition device shown in FIG. 1 will be described with reference to FIGS. 10 to 13, centering on differences from the first embodiment.

Figure 10:
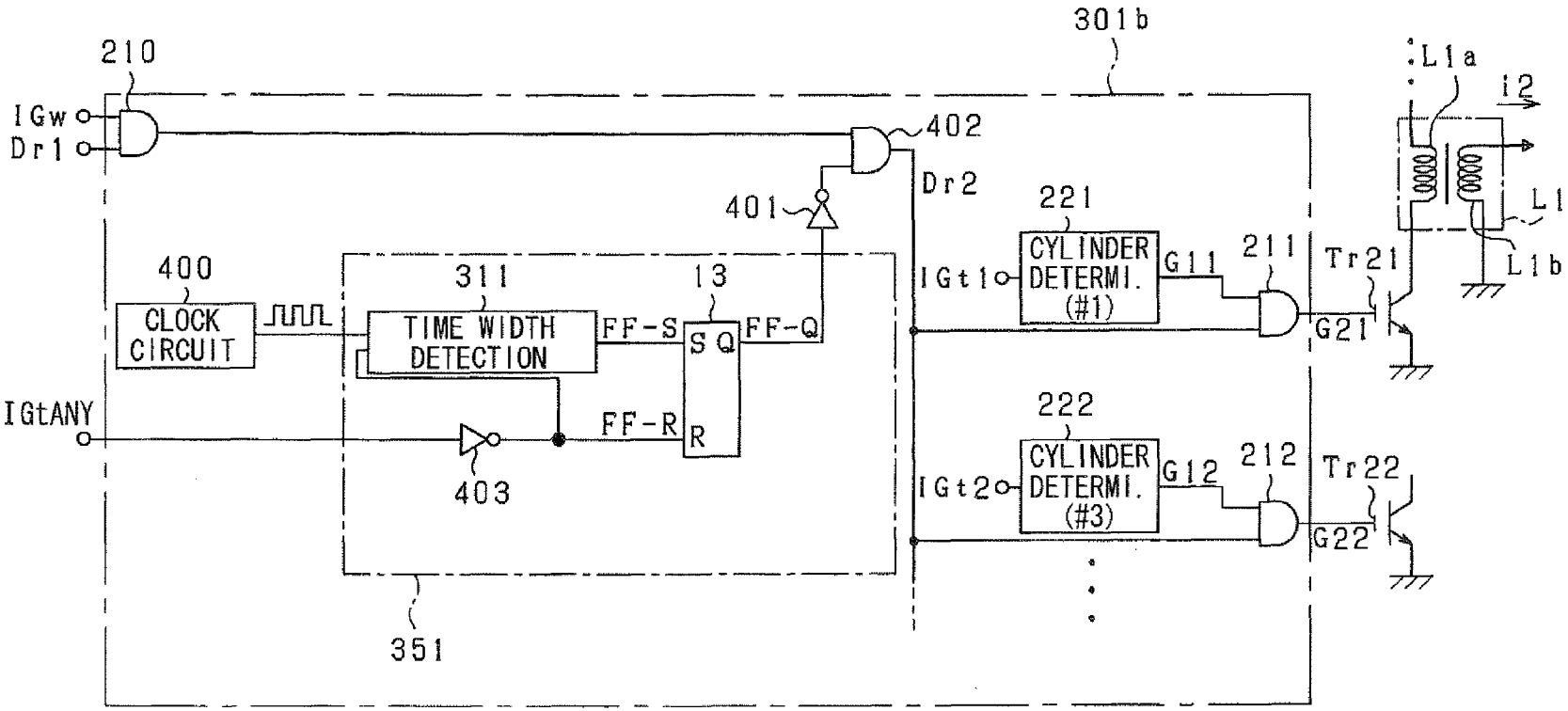
FIG. 10 is a circuit diagram showing an ignition device for an internal combustion engine according to a third embodiment of the present invention.

First, a construction of the ignition device according to the present embodiment will be explained with reference to FIGS. 10 and 11. FIG. 10 is a circuit diagram corresponding to FIG. 1. The same sign is used for the same element shown in both of FIGS. 1 and 10.

Construction of a wrong ignition prevention circuit 351 of the ignition device according to the present embodiment differs from that of the wrong ignition prevention circuit 251 of the ignition device according to the first embodiment. A multiple ignition control section 301*b* is constructed by adding a clock circuit 400, an inverter 4011 and an AND circuit 402 to the multiple ignition control section 201*b* according to the first embodiment. The clock circuit 400 outputs a pulse signal of a fixed cycle. The pulse signal of the clock circuit 400 is inputted into a time width detection circuit 311 of the wrong ignition prevention circuit 351.

The time width detection circuit 311 of the wrong ignition prevention circuit 351 differs from the time width detection circuit 11 according to the first embodiment. The wrong ignition prevention circuit 351 has an inverter 403 in place of the rising timing detection circuit 12 according to the first embodiment. That is, the wrong ignition prevention circuit 351 uses an inversion signal (an output signal of the inverter 403) of the ignition signal IGtANY as the FF-R signal of the RS flip-flop 13. The FF-R signal is inputted also into the time width detection circuit 311.

Figure 11:
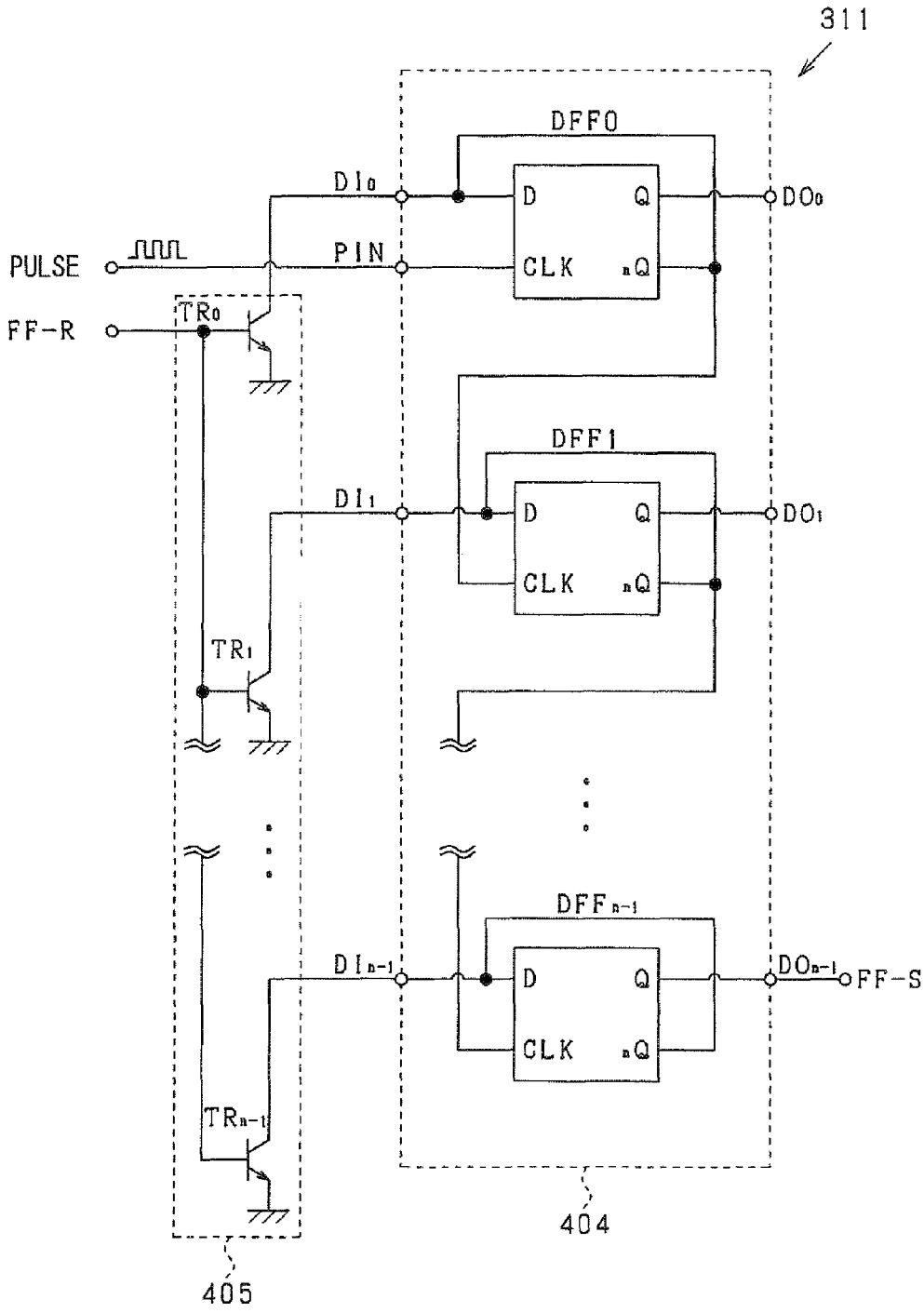
FIG. 11 is a circuit diagram showing the ignition device according to the third embodiment.

FIG. 11 is a circuit diagram showing a construction of the time width detection circuit 311. The time width detection circuit 311 has a counter circuit 404 for counting the pulse number of the pulse signal of the clock circuit 400 and a reset circuit 405 for bringing the counter circuit 404 to a reset state. The time width detection circuit 311 measures time, in which the ignition signal IGtANY is logically high (H), with the counter circuit 404 and outputs the FF-S signal based on the time measurement result. The reset state is a state where the measurement value of the counter circuit 404 returns to zero and the pulse number of the pulse signal is not counted.

The time width detection circuit 311 will be explained in more detail below. The counter circuit 404 is an n-bit counter circuit consisting of multiple D flip-flops DFF0-DFFn−1. In the counter circuit 404, a D terminal (a data input terminal) and an nQ terminal (a negative output terminal) are connected to each other in the D flip-flop of each bit. Between the adjacent D flip-flops, the nQ terminal of the lower order D flip-flop is connected with a CLK terminal (a clock input terminal) of the higher order D flip-flop. In the counter circuit 404, the CLK terminal of the D flip-flop of the least significant bit serves as a pulse input terminal PIN. The D terminals and Q terminals (positive output terminals) of the D flip-flops of the respective bits serve as data input terminals DI0-DIn−1 and data output terminals DO0-DOn−1 respectively. An output terminal of the clock circuit 400 is connected to the pulse input terminal PIN. The reset circuit 405 is connected to the data input terminals DI0-DIn−1. An S terminal of the RS flip-flop 13 is connected to the data output terminal DOn−1 of the most significant bit. Thus, the data output signal of the most significant bit is inputted into the RS flip-flop 13 as the FF-S signal.

The reset circuit 405 brings the counter circuit 404 to the reset state when the FF-R signal is logically high (H) (i.e., when the ignition signal IGtANY is logically low (L)). The reset circuit 405 cancels the reset state of the counter circuit 404 when the FF-R signal is logically low (L) (i.e., when the ignition signal IGtANY is logically high (H)). The reset circuit 405 according to the present embodiment is mainly composed of transistors TR0-TRn−1 corresponding to the respective bits of the counter circuit 404. In more detail, the reset circuit 405 is structured such that the FF-R signal is inputted into base terminals of the respective transistors TR0-TRn−1. The data input terminals DI0-DIn−1 of the counter circuit 404 are connected to collector terminals of the respective transistors TR0-TRn−1. The ground is connected to emitter terminals of the respective transistors TR0-TRn−1. In such the structure, if the FF-R signal becomes logically low (L) (when the ignition signal IGtANY becomes logically high (H)), the transistors TR0-TRn−1 are brought to an OFF state in the reset circuit 405, and the data input terminals DI0-DIn−1 are brought to a state of high impedance in the counter circuit 404. Thus, the reset state of the counter circuit 404 is canceled. If the FF-R signal becomes logically high (H) (when the ignition signal IGtANY becomes logically low (L)), the transistors TR0-TRn−1 are brought to an ON state in the reset circuit 405, and the data input terminals DI0-DIn−1 are brought to a logically low (L) state in the counter circuit 404. Thus, the counter circuit 404 is brought to the reset state.

The above-described wrong ignition prevention circuit 351 is structured such that the counter circuit 404 measures the time, in which the ignition signal IGtANY is logically high (H), and the data output signal of the most significant bit of the counter circuit 404 is outputted as the FF-S signal. When the elapsed time from the rising timing of the ignition signal IGtANY is shorter than abnormality determination time, the data output signal (the FF-S signal) of the most significant bit of the counter circuit 404 is logically low (L) (refer to part (f) of FIG. 12). When the elapsed time from the rising timing of the ignition signal IGtANY is equal to or longer than the abnormality determination time, the data output signal (the FF-S signal) of the most significant bit of the counter circuit 404 is logically high (H) (refer to part (f) of FIG. 13). The above-described abnormality determination time is set in accordance with the number of stages (i.e., bit number) of the counter circuit 404 and the generation cycle of the pulse signal of the clock circuit 400.

If the elapsed time from the rising timing of the ignition signal IGtANY further lengthens over the abnormality determination time, the data output signal (the FF-S signal) of the most significant bit of the counter circuit 404 will return to the logically low (L) state. However, by a latch function of the RS flip-flop 13, the output signal (the FF-Q signal) of the wrong ignition prevention circuit 351 is maintained to be logically high (H). Thus, a situation that the output signal of the wrong ignition prevention circuit 351 indicates the ignition permission (i.e., the FF-Q signal becomes logically low (L)) although the elapsed time from the rising timing of the ignition signal IGtANY is abnormality determination time can be prevented. In this regard, the effect of providing the RS flip-flop 13 in the subsequent stage of the time width detection circuit 311 according to the present embodiment as described above is significant.

As shown in FIG. 10, the multiple ignition control section 301*b* is structured such that the logical product signal (AND signal) of the inversion signal (the output signal of the inverter 401) of the FF-Q signal of the wrong ignition prevention circuit 351 and the output signal of the AND circuit 210 is outputted from the AND circuit 402 to the AND circuits 211, 212, etc. as the drive signal Dr2. In such the structure, if the FF-Q signal of the wrong ignition prevention circuit 351 becomes logically low (L), the ignition control is performed by the drive signal Dr2 corresponding to the multiple period signal IGw and the drive signal Dr1. That is, the ignition is permitted in the respective cylinders. If the FF-Q signal of the wrong ignition prevention circuit 351 becomes logically high (H), the drive signal Dr2 is fixed to be logically low (L) irrespective of the multiple period signal IGw and the drive signal Dr1. That is, execution of the ignition is prohibited in the respective cylinders.

Figure 12:
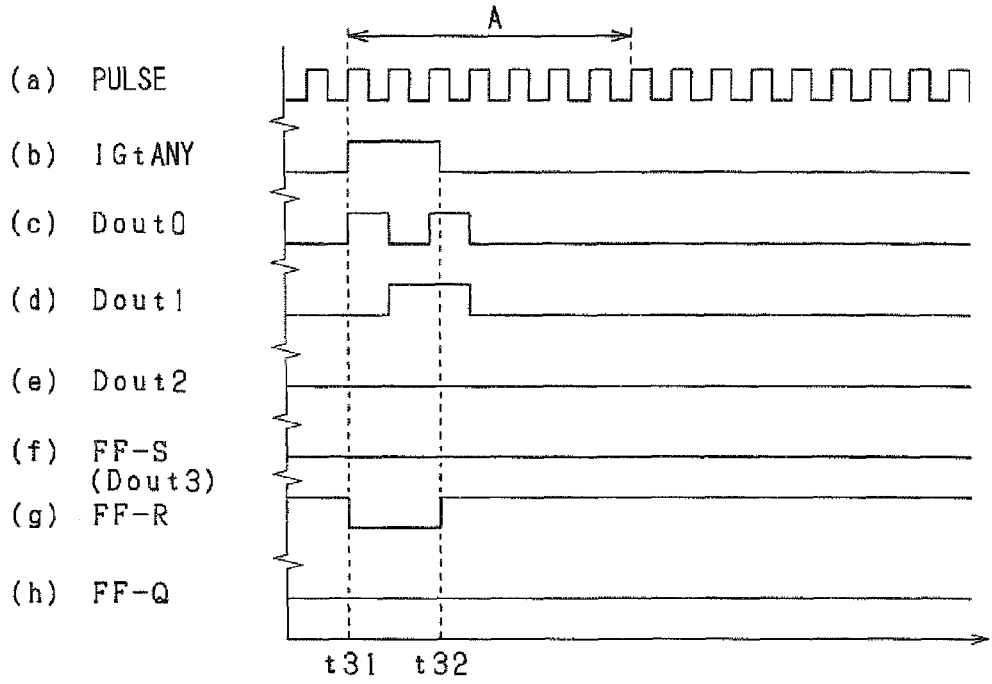
FIG. 12 is a timing chart showing an operation mode of the ignition device according to the third embodiment.
Figure 13:
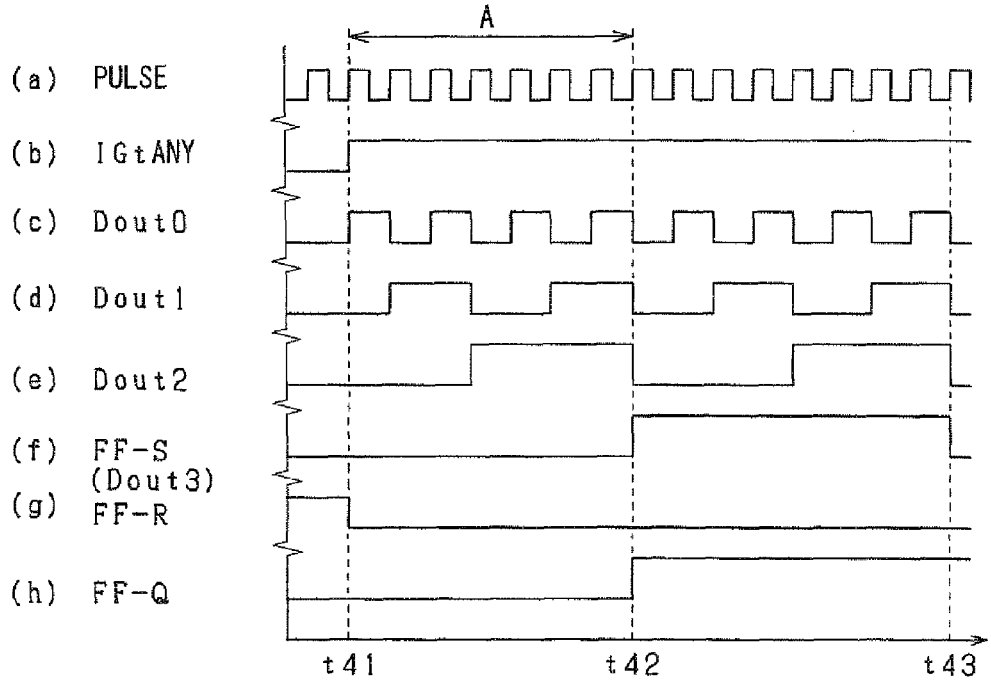
FIG. 13 is a timing chart showing another operation mode of the ignition device according to the third embodiment.

Next, an operation of the ignition device according to the present embodiment will be explained by comparing the case where the ignition by the ignition device according to the present embodiment is directed at the normal timing and the case where the ignition is directed at the abnormal timing with reference to FIGS. 12 and 13. Part (a) in FIG. 12 or 13 shows the pulse signal of the clock circuit 400, part (b) shows the ignition signal IGtANY, parts (c) to (e) respectively show data output signals Dout0, Dout1, Dout2 of the bits (from the least significant bit to the second bit) of the counter circuit 404, and parts (f) to (h) respectively show the FF-S signal, the FF-R signal and the FF-Q signal. The example shown in FIG. 12 or 13 assumes that the counter circuit 404 is a four-bit counter circuit.

First, with reference to FIG. 12, the case where the ignition by the ignition device according to the present embodiment is directed at the normal timing will be explained. In this example, the ignition signal IGtANY is logically low (L) in a period before timing t31 (refer to part (a) of FIG. 12). Therefore, in the same period (i.e., the period before the timing t31), the FF-R signal is logically high (H) (refer to part (g) of FIG. 12). Thus, the input to the R terminal of the RS flip-flop 13 is logically high (H) (refer to part (9) of FIG. 12). As a result, the RS flip-flop 13 is in the reset state, and the FF-Q signal of the RS flip-flop 13 is logically low (L) (refer to part (h) of FIG. 12). The input to the reset circuit 405 of the time width detection circuit 311 is logically high (H). As a result, with the rising of the pulse signal of the clock circuit 400 after the timing t31, the counter circuit 404 is brought to the reset state and the data output signals Dout0-Dout2 and the FF-S signal of the counter circuit 404 become logically low (L) (refer to parts (c) to (f) of FIG. 12).

If the ignition signal IGtANY becomes logically high (H) at the timing t31, the FF-R signal becomes logically low (L) and the input to the reset circuit 405 becomes logically low (L) (refer to parts (b) and (g) of FIG. 12). Thus, the reset state of the counter circuit 404 is canceled and the measurement of the time, in which the ignition signal IGtANY is logically high (H), is started with the counter circuit 404 (refer to parts (c) to (f) of FIG. 12).

After that, if the ignition signal IGtANY becomes logically low (L) at timing t32, the FF-R signal becomes logically high (H) and the input to the reset circuit 405 become logically high (H) (refer to parts (b) and (g) of FIG. 12). Thus, with the rising of the pulse signal of the clock circuit 400 after the timing 32, the counter circuit 404 is brought to the reset state again (refer to timing t32 of parts (c) to (f) of FIG. 12).

In this example, the ignition signal IGtANY falls at the timing t32 when the elapsed time from the rising timing of the ignition signal IGtANY is shorter than the abnormality determination time (indicated by interval A in FIG. 12). Therefore, the output signal (the FF-Q signal) of the wrong ignition prevention circuit 351 at the falling timing of the ignition signal IGtANY is logically low (L). That is, the ignition is permitted at the falling timing of the ignition signal IGtANY. Therefore, the ignition is performed at either one of the falling timings of the ignition signals IGt1-IGt4.

Next, with reference to FIG. 13, an operation of the ignition device in the case where the ignition by the ignition device according to the present embodiment is directed at the abnormal timing will be explained. If the ignition signal IGtANY becomes logically high (H) at timing t41, the counter circuit 404 starts measuring the time, in which the ignition signal IGtANY is logically high (H) (refer to parts (c) to (f) of FIG. 13).

If the elapsed time from the rising timing of the ignition signal IGtANY reaches the abnormality determination time A at timing t42, the data output signal (the FF-S signal) of the most significant bit of the counter circuit 404 changes from the logically low (L) state to the logically high (H) state. Accordingly, the FF-Q signal of the RS flip-flop 13 becomes logically high (H).

If the elapsed time from the rising timing of the ignition signal IGtANY reaches the time twice as long as the abnormality determination time A at timing t43, the data output signal (the FF-S signal) of the most significant bit of the counter circuit 404 changes from the logically high (H) state to the logically low (L) state. However, the FF-Q signal is held to be logically high (H) by the latch function of the RS flip-flop 13.

Thus, after the timing t42, the output signal (the FF-Q signal) of the wrong ignition prevention circuit 351 is logically high (H), and the ignition is prohibited. Therefore, even if either one of the ignition signals IGt1-IGt4 falls at certain timing after the timing t42, the ignition is not performed at the certain timing.

As explained above, the ignition device of the internal combustion engine according to the present embodiment exerts following effects in addition to the effects (1), (2) and (5) to (15) of the first embodiment or similar effects.

(18) The time width detection circuit 311 starts count-up of the counter circuit 404 when the predetermined reference signal (the rising of one of the ignition signals IGt1, IGt2, IGt3, IGt4) is generated. The time width detection circuit 311 determines whether the predetermined start signal (the falling of one of the ignition signals IGt1, IGt2, IGt3, IGt4) is generated at the start timing based on the measurement value of the counter circuit 404. Thus, the generating timing of the start signal can be determined accurately based on the measurement value of the counter circuit 404.

(19) The time width detection circuit 311 is structured such that the counter circuit 404 becomes the reset state before the generating timing of the reference signal and the reset state of the counter circuit 404 is removed at the generating timing of the reference signal. With such the construction, the generating timing of the start signal can be determined easily based on whether the measurement value of the counter circuit 404 exceeds the predetermined permissible value.

The above described embodiments may be modified and implemented as follows, for example.

It is also effective to provide the ignition device according to the second embodiment with a device for storing information specifying a cylinder, in which the ignition is prohibited by the above-described transistor 14, among the four cylinders. For example, the FF-Q signal (each of the FF-Q1 signal, etc.) of the RS flip-flop 13 may be stored in a distinguishable manner for each cylinder (for example, in a predetermined storage device). Thus, the data about the frequency of the prohibition, i.e., the data about the frequency of occurrence of the abnormality, can be stored in a distinguished manner for each cylinder. Eventually, information indicating the ignition system of a certain cylinder that specifically tends to cause the abnormality can be grasped. Also, in the case where the abnormality occurs successively in a specific cylinder, early recovery from the lowering of the engine performance resulting from the abnormality and the like is enabled by performing repair, component replacement and the like of the ignition system of the specific cylinder. In this case, it is effective to store the data in a predetermined storage device (for example, EEPROM or backup RAM) capable of maintaining the data even after stoppage of a main power supply to the ECU, while relating the data with predetermined parameters (for example, date and time of data acquisition and the like) if needed. Thus, the data is maintained in the storage device in a non-volatile manner without being erased even after the engine is stopped and the power supply to the ECU is blocked out. As a result, preservation of the data and eventually reading out of the data over a long period of time are enabled. If the data is associated with the predetermined parameters when the data is stored, the data retrieval is facilitated by using the parameter when the data is read. Thus, data analysis and the like can be performed easily and appropriately.

The wrong ignition prevention circuit 351 according to the third embodiment may be applied to the ignition device according to the second embodiment. That is, the wrong ignition prevention circuits 251, 252, etc. according to the second embodiment may be replaced with the wrong ignition prevention circuit 351 according to the third embodiment. Thus, a logical product signal (an AND signal) of the output signal of each of the cylinder determination circuits 221, 222, etc, for the respective cylinders according to the second embodiment and the inversion signal of the FF-Q signal of the wrong ignition prevention circuit 351 for each cylinder may be inputted into each of the AND circuits 211, 212, etc. for the respective cylinders.

It may be diagnosed whether the above-mentioned prohibition is surely performed based on the compatibility between the output (the FF-Q signal) of the RS flip-flop 13 and the magnitude of the current i1 flowing through the primary ignition coil L1*a*. For example, it may be determined that the abnormality is caused in the above-described wrong ignition prevention circuits 251, 252 etc. when the current larger than a permissible level (for example, current greater than a predetermined value) flows through the primary ignition coil L1*a* although the logically high (H) signal is outputted as the FF-Q signal of the RS flip-flop 13 (i.e., even though the above-described prohibition is performed).

An arbitrary time measuring device (for example, a timer device provided by a program or a circuit) can be used as the device for measuring the time from the generation of the above-described reference signal to the generation of the start signal.

It is not an indispensable configuration that the above-mentioned reference electric potential Vt is the fixed value. For example, the reference electric potential Vt may be variably set based on predetermined parameters such as a degradation state of the system (the engine ignition system).

Figure 17:
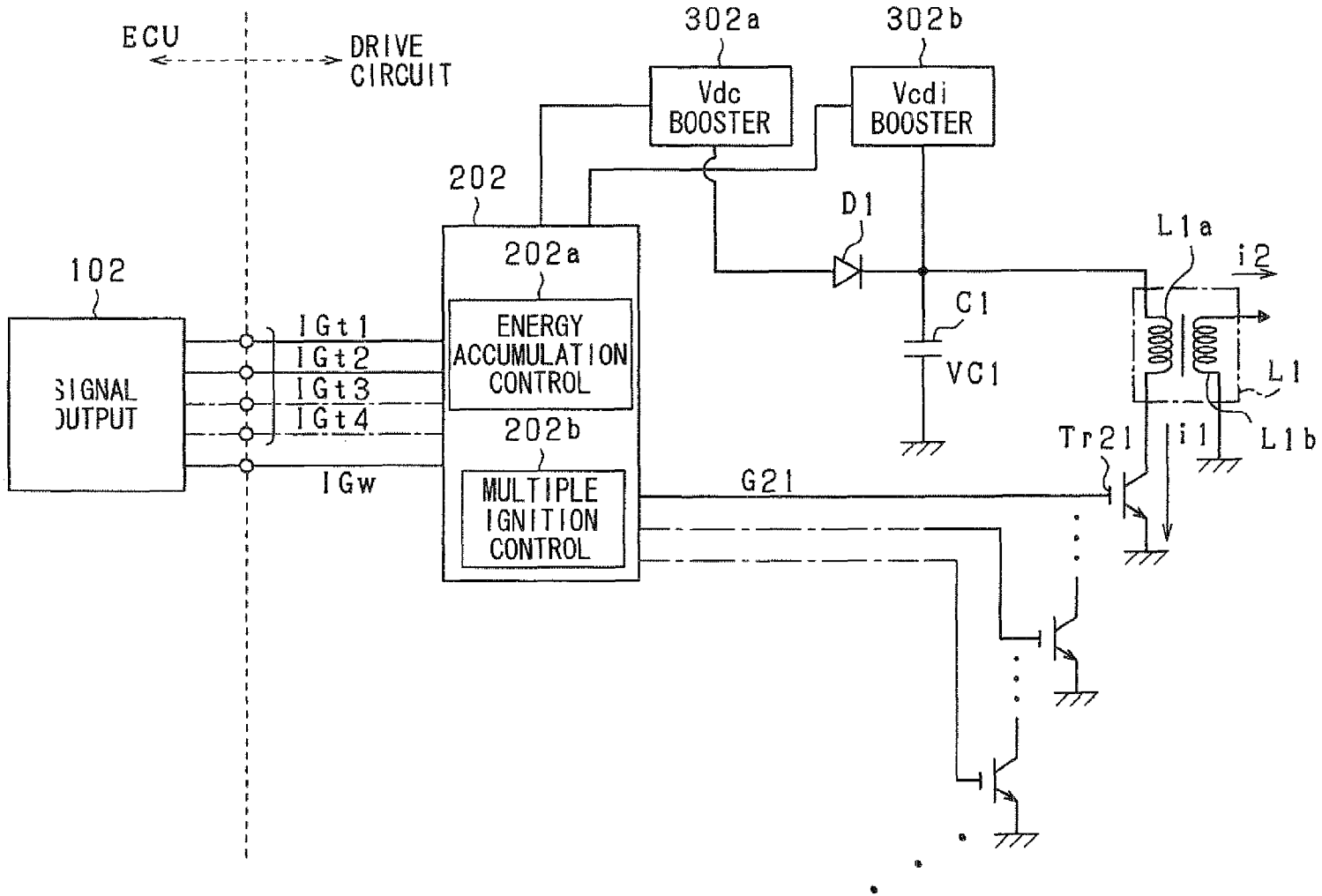
FIG. 17 RELATED ART
FIG. 17 is a circuit diagram showing a multiple electric discharge ignition type ignition device of another related art.
Figure 18:
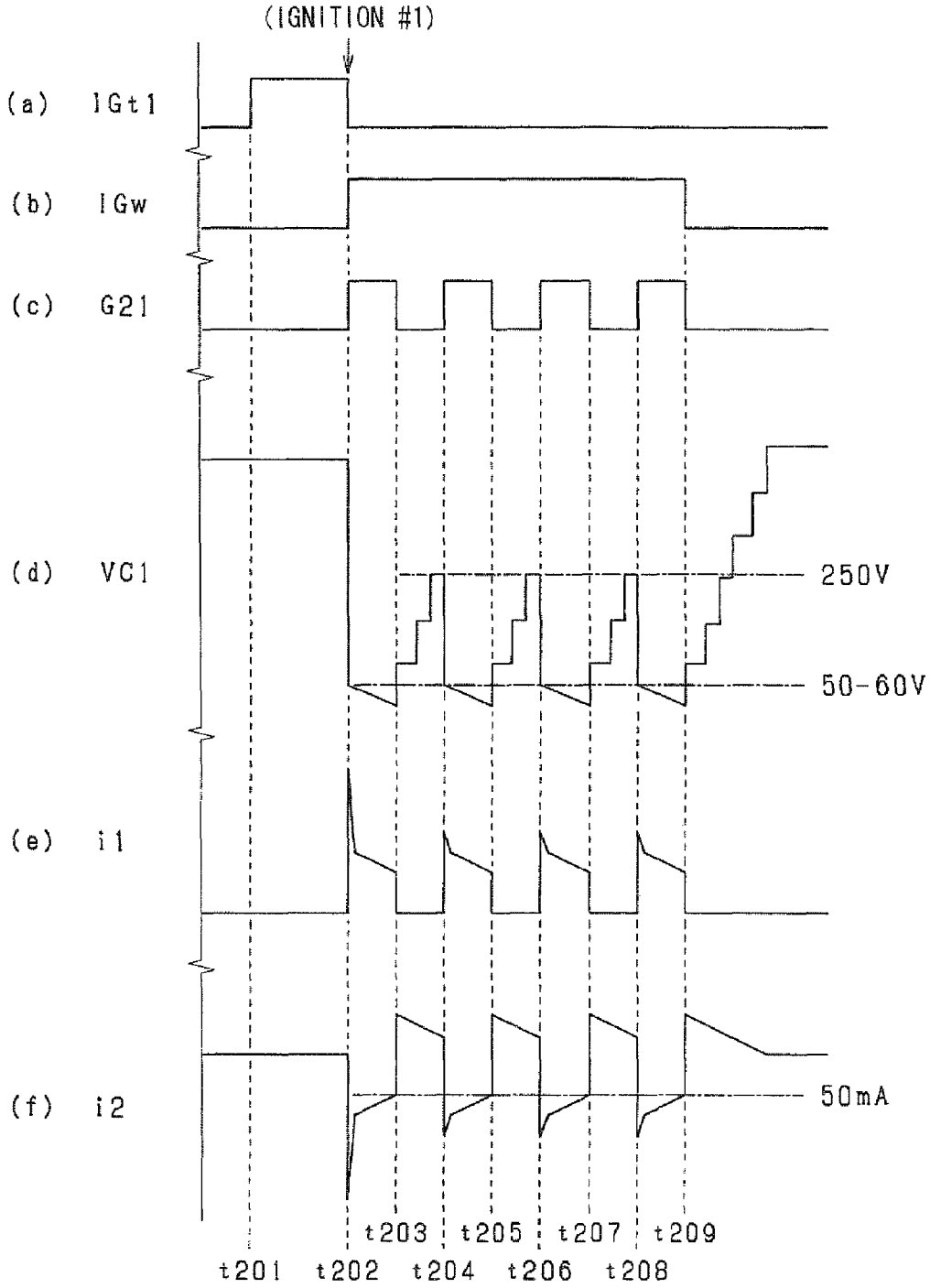
FIG. 18 RELATED ART
FIG. 18 is a timing chart showing an operation mode of the ignition device of the another related art.
Figure 19:
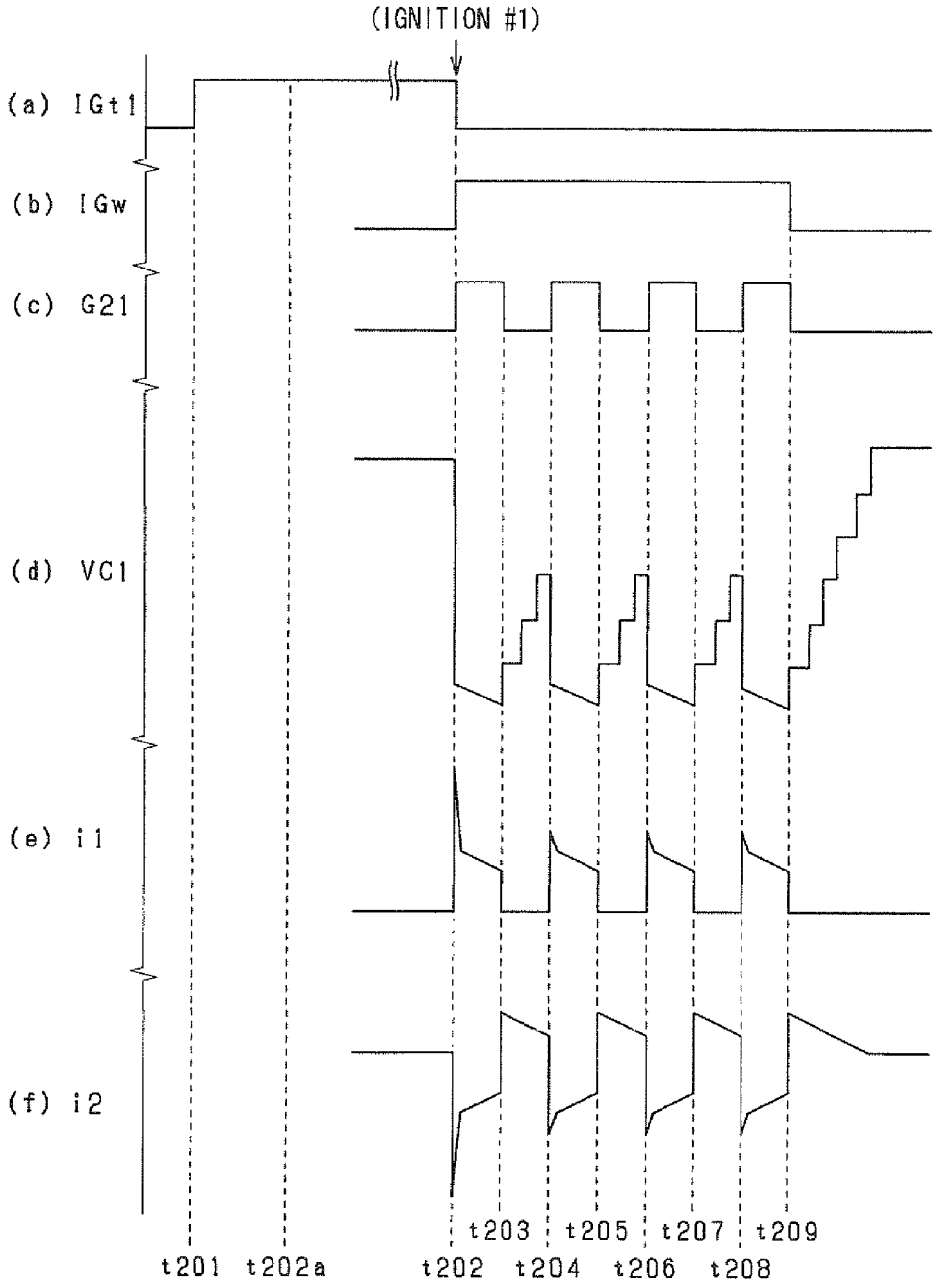
FIG. 19 RELATED ART
FIG. 19 is a timing chart showing another operation mode of the ignition device of the another related art.

The application of the wrong ignition prevention circuits 251, 252, etc. is not limited to the application to the construction shown in FIG. 14. For example, the wrong ignition prevention circuits 251, 252, etc. may be applied to the structure shown in FIG. 17. Moreover, the ignition device is not limited to the multiple electric discharge ignition type ignition device but may be an ignition device that performs the ignition only once during a combustion cycle, for example.

In place of the above-described wrong ignition prevention circuits 251, 252, etc., the above-described prohibition processing may be performed by software (programs) with the ECU or the like, for example. However, it is more useful to perform the prohibition with the hardware (specifically with the circuits) in order to surely perform the prohibition.

The kind and the system structure of the internal combustion engine as the ignition target can also be arbitrarily modified in accordance with the use and the like. For example, a spark ignition type direct-injection gasoline engine (a direct-injection engine) may be used as a target of the ignition. An arbitrary engine can be used as the target of the ignition as long as the engine is a spark ignition type internal combustion engine.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An ignition device for a spark ignition type internal combustion engine that directs ignition with generation of a predetermined start signal, the ignition device comprising:

a timing determination means for determining whether the start signal is generated at predetermined start timing; and a prohibition means for prohibiting ignition based on the start signal when the timing determination means determines that the start signal is not generated at the predetermined start timing, wherein the predetermined start timing is set as a predetermined time elapsed after generation of a predetermined reference signal, the timing determination means determines whether the start signal is generated at the predetermined start timing based on elapsed time from generation of the predetermined reference signal to generation of the start signal, and the timing determination means starts charging of a time measuring capacitor when the reference signal is generated and determines whether the start signal is generated at the predetermined start timing based on whether the time measuring capacitor charge exceeds a permissible level before the start signal is generated.

2. The ignition device as in claim 1, wherein the timing determination means determines whether the start signal is generated at the predetermined start timing based on magnitude of a comparator output, into which comparator a voltage corresponding to the time measuring capacitor charge and to a specified electric potential corresponding to the permissible level are inputted.

3. The ignition device as in claim 1, wherein the timing determination means outputs a result of the determination of whether the start signal is generated at the predetermined start timing as an output of an RS flip-flop, into which a reset signal is inputted when the reference signal is generated and a set signal is inputted when the time from generation of the reference signal to generation of the start signal becomes longer than a permissible level.

4. The ignition device as in claim 1, wherein the ignition directed by the generation of the start signal is performed as multiple electric discharge ignition for performing the ignition multiple times during one combustion cycle, the ignition device further comprising:

a multiple period signal outputting means for outputting a multiple period signal indicating a period for continuously performing the multiple electric discharge ignition when the start signal is generated;

a pulse signal outputting means for outputting a pulse signal directing the multiple electric discharge ignition during the output of the multiple period signal; and a multiple electric discharge ignition performing means for performing the multiple electric discharge ignition during the output of the pulse signal based on the pulse signal, wherein the prohibition means prohibits the output of the pulse signal when the timing determination means determines that the start signal is not generated at the start timing.

5. The ignition device as in claim 1 wherein the internal combustion engine performs the ignition by energizing an ignition plug and energization/de-energization of the ignition plug switches in accordance with an ON/OFF state of an ignition switch as a switching element, the ignition device further comprising:

a switch control circuit for switching the ON/OFF state of the ignition switch based on one or more predetermined parameters.

6. The ignition device as in claim 5, further comprising:

a signal determination means for determining whether both of a switch signal indicating an ON/OFF mode of the ignition switch and the start signal are generated, wherein the ignition switch is a normally-off type switching element, the switch control circuit switches the ON/OFF state of the ignition switch in an ON/OFF mode corresponding to the switch signal when the signal determination means determines that both of the switch signal and the start signal are generated, and when the prohibition means performs the prohibition, the prohibition means invalidates at least one of the switch signal and the start signal to cause the signal determination means to determine that at least one of the switch signal and the start signal is not generated.

7. The ignition device as in claim 5, further comprising:

an ignition coil having a primary coil and a secondary coil for controlling the energization/de-energization of the ignition plug, wherein energization/de-energization of the primary coil switches in accordance with the ON/OFF state of the ignition switch and the secondary coil is provided to an energization route of the ignition plug.

8. The ignition device as in claim 7, further comprising:

a multiple electric discharge performing means for repeatedly switching on and off the ignition switch to cause a primary current to intermittently flow through the primary coil such that a secondary current is repeatedly generated in the secondary coil when the start signal is generated, thereby causing the ignition plug to perform the multiple electric discharge.

9. The ignition device as in claim 7, further comprising:

an ignition capacitor that is used for the ignition and is connected in parallel with the primary coil, wherein the ignition switch is connected in series with the primary coil, and the primary coil is supplied with an electric charge accumulated in the ignition capacitor when the ignition switch is switched on.

10. The ignition device as in claim 5, wherein the prohibition means allows the ignition switch to be switched on by the generation of the start signal when the prohibition means does not perform the prohibition and prohibits the ignition switch from being switched on even if the start signal is generated when the prohibition means performs the prohibition.

11. The ignition device as in claim 10, wherein the prohibition means prohibits the switching on of the ignition switch with a circuit when the prohibition means performs the prohibition.

12. The ignition device as in claim 11, wherein the ignition switch is a normally-off type transistor that is switched on if a logically high electric potential is applied to a gate thereof, and the prohibition means fixes the electric potential of the gate to a logically low electric potential when the prohibition means performs the prohibition.

13. The ignition device as in claim 1, wherein the internal combustion engine is a multi-cylinder engine having a plurality of cylinders, the ignition device further comprising:

a cylinder determination and ignition performing means for determining which one of the cylinders is a target cylinder that should perform the ignition presently and for performing the ignition in the target cylinder based on the start signal when the prohibition by the prohibition means is not performed, wherein the timing determination means determines whether the start signal is generated at the start timing in the target cylinder, and when the timing determination means determines that the start signal is not generated at the start timing, the prohibition means prohibits the ignition based on the start signal only in the target cylinder related to the determination.

14. The ignition device as in claim 13, further comprising:

a storage means for storing information indicating which cylinder is prohibited from performing the ignition by the prohibition means among the plurality of cylinders.

15. The ignition device as in claim 1, wherein the internal combustion engine is a multi-cylinder engine having a plurality of cylinders, the ignition device further comprising:

a cylinder determination and ignition performing means for determining which one of the cylinders is a target cylinder that should perform the ignition presently and for performing the ignition in the target cylinder based on the start signal when the prohibition by the prohibition means is not performed, wherein the timing determination means determines whether the start signal is generated at the start timing in the target cylinder, and when the timing determination means determines that the start signal is not generated at the start timing, the prohibition means prohibits the ignition based on the start signal in all of the plurality of cylinders including the target cylinder related to the determination.

* * * * *